US007951519B2

(12) United States Patent
Iwazaki et al.

(10) Patent No.: US 7,951,519 B2
(45) Date of Patent: May 31, 2011

(54) TONER FOR DEVELOPMENT OF ELECTROSTATIC IMAGE, METHOD FOR MANUFACTURING THE SAME, DEVELOPER FOR DEVELOPMENT OF ELECTROSTATIC IMAGE, TONER CARTRIDGE, PROCESS CARTRIDGE, AND IMAGE FORMING APPARATUS

(75) Inventors: Eisuke Iwazaki, Kanagawa (JP); Shuji Sato, Kanagawa (JP); Atsushi Sugawara, Kanagawa (JP); Hiroshi Nakazawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 77 days.

(21) Appl. No.: 12/052,361

(22) Filed: Mar. 20, 2008

(65) Prior Publication Data

US 2009/0081573 A1 Mar. 26, 2009

(30) Foreign Application Priority Data

Sep. 20, 2007 (JP) ..... 2007-243912

(51) Int. Cl.
*G03G 9/08* (2006.01)

(52) U.S. Cl. ..... 430/109.4; 430/108.1; 430/180.7; 430/137.14; 430/137.16

(58) Field of Classification Search ..... 430/109.4, 430/108.7, 108.1, 137.14, 137.16
See application file for complete search history.

(56) References Cited

U.S. PATENT DOCUMENTS

| | | | | |
|---|---|---|---|---|
| 5,346,797 | A | 9/1994 | Kmiecik-Lawrynowicz et al. | |
| 7,335,453 | B2 * | 2/2008 | Sacripante et al. | 430/108.4 |
| 7,368,214 | B2 * | 5/2008 | Ishiyama et al. | 430/111.4 |
| 7,488,562 | B2 * | 2/2009 | Daimon et al. | 430/109.1 |
| 7,498,113 | B2 * | 3/2009 | Matsumura et al. | 430/109.4 |
| 7,547,499 | B2 * | 6/2009 | Veregin et al. | 430/109.1 |
| 7,575,841 | B2 * | 8/2009 | Daimon et al. | 430/109.4 |
| 7,713,669 | B2 * | 5/2010 | Mizutani et al. | 430/109.4 |
| 2002/0018952 | A1 | 2/2002 | Daimon et al. | |
| 2003/0104296 | A1 | 6/2003 | Hamano et al. | |
| 2006/0160011 | A1 * | 7/2006 | Inoue et al. | 430/109.4 |
| 2006/0204880 | A1 * | 9/2006 | Mizutani et al. | 430/109.4 |
| 2006/0216626 | A1 * | 9/2006 | Sacripante et al. | 430/109.4 |
| 2006/0216628 | A1 * | 9/2006 | Nakamura et al. | 430/110.2 |
| 2006/0216630 | A1 * | 9/2006 | Ninomiya et al. | 430/111.4 |
| 2006/0222995 | A1 * | 10/2006 | Moriyama et al. | 430/122 |
| 2006/0240353 | A1 * | 10/2006 | Matsumura et al. | 430/109.4 |
| 2006/0246368 | A1 * | 11/2006 | Matsumoto et al. | 430/109.2 |
| 2006/0292477 | A1 * | 12/2006 | Daimon et al. | 430/109.4 |
| 2007/0048647 | A1 * | 3/2007 | Daimon et al. | 430/110.2 |

(Continued)

FOREIGN PATENT DOCUMENTS

JP A 63-282752 11/1988

(Continued)

OTHER PUBLICATIONS

Feb. 23, 2010 foreign Office Action issued in JP Application No. 2007-243912 (with English translation).

*Primary Examiner* — Hoa V Le
(74) *Attorney, Agent, or Firm* — Oliff & Berridge, PLC

(57) ABSTRACT

A toner for development of an electrostatic image includes at least a crystalline polyester resin and a colorant. The toner shows a dielectric loss index ∈" of 0.1 or less at 0.1 Hz and 500 V at 30° C. and 90% RH.

24 Claims, 2 Drawing Sheets

U.S. PATENT DOCUMENTS

| | | | | |
|---|---|---|---|---|
| 2007/0092822 | A1 | 4/2007 | Matsumura et al. | |
| 2007/0092922 | A1 | 4/2007 | Salamone et al. | |
| 2007/0134580 | A1* | 6/2007 | Yaguchi et al. | 430/108.7 |
| 2007/0196758 | A1 | 8/2007 | Sasaki et al. | |
| 2007/0218386 | A1* | 9/2007 | Suzuki et al. | 430/108.4 |
| 2007/0218396 | A1* | 9/2007 | Tomita | 430/123.52 |
| 2008/0131802 | A1* | 6/2008 | Mizutani et al. | 430/109.4 |
| 2009/0068578 | A1* | 3/2009 | Murakami et al. | 430/105 |
| 2009/0123864 | A1* | 5/2009 | Sacripante et al. | 430/109.4 |
| 2009/0181317 | A1* | 7/2009 | Moriya | 430/109.4 |
| 2010/0129748 | A1* | 5/2010 | Inoue et al. | 430/108.4 |

FOREIGN PATENT DOCUMENTS

| | | | |
|---|---|---|---|
| JP | A 6-250439 | | 9/1994 |
| JP | 2000-267355 | A | 9/2000 |
| JP | 2000-275907 | A | 10/2000 |
| JP | 2004-191623 | A | 7/2004 |
| JP | A 2004-246081 | | 9/2004 |
| JP | 2006-003390 | A | 1/2006 |
| JP | A 2006-10822 | | 1/2006 |
| JP | A 2006-317928 | | 11/2006 |
| JP | 2007-225838 | A | 9/2007 |

* cited by examiner

TONER FOR DEVELOPMENT OF ELECTROSTATIC IMAGE, METHOD FOR MANUFACTURING THE SAME, DEVELOPER FOR DEVELOPMENT OF ELECTROSTATIC IMAGE, TONER CARTRIDGE, PROCESS CARTRIDGE, AND IMAGE FORMING APPARATUS

CROSS-REFERENCE TO RELATED APPLICATION

This application is based on and claims priority under 35 USC 119 from Japanese patent Application No. 2007-243912 filed on Sep. 20, 2007.

BACKGROUND

1. Technical Field

The present invention relates to a toner for development of an electrostatic image, a method for manufacturing the same, a developer for development of an electrostatic image, a toner cartridge, a process cartridge, and an image forming apparatus.

2. Related Art

Methods of visualizing image information via an electrostatic image, such as electrophotography, have been utilized in various fields at present. In electrophotography, an electrostatic image is formed on a photoreceptor by charging and exposure steps, and the electrostatic image is developed with a developer containing a toner for development of an electrostatic image (hereinafter referred to sometimes as simply "toner") and visualized through transfer and fixation steps.

As the developer used herein, a 2-component developer consisting of a toner and a carrier and a 1-component developer using only a magnetic toner or a nonmagnetic toner are known. Usually, production of the toner uses a kneading pulverizing process that involves fusing and kneading a thermoplastic resin with a colorant, a charge control agent and a release agent such as wax, then cooling the mixture, finely dividing it and further classifying the divided particles.

If necessary, inorganic or organic fine particles are added sometimes to the surfaces of the toner particles in order to improve fluidity and cleanability. These methods can produce considerably superior toners.

From the viewpoint of low-temperature fixability, a toner by an emulsion polymerization aggregation process using a polyester resin having high sharp-melting properties has been proposed. This toner uses a crystalline polyester resin to achieve low-temperature fixability. However, colorant dispersibility therein is poor, and desired density is hardly achieved relative to the amount of the colorant added.

SUMMARY

According to an aspect of the invention, there is provided a toner for development of an electrostatic image, comprising at least a crystalline polyester resin and a colorant, the toner showing a dielectric loss index ∈" of 0.1 or less at 0.1 Hz and 500 V at 30° C. and 90% RH.

BRIEF DESCRIPTION OF THE DRAWINGS

Exemplary embodiments of the present invention will be described in detail based on the following figures, wherein.

DETAILED DESCRIPTION

Figure 1:
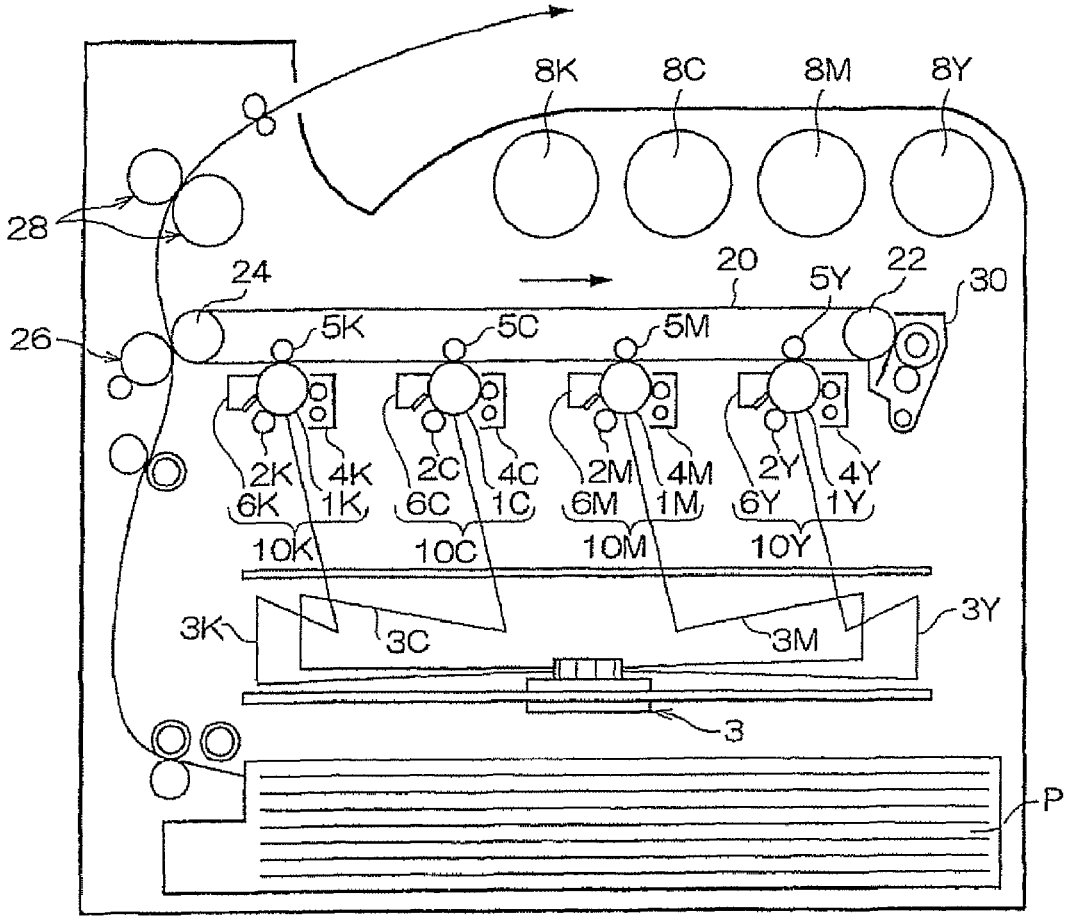
FIG. 1 is a schematic constitutional view showing an example of an image forming apparatus according to an aspect of the present invention.

<A Toner for Development of an Electrostatic Image, a Method for Manufacturing a Toner for Development of an Electrostatic Image>

A toner for development of an electrostatic image according to the invention (also referred to hereinafter as "a toner according to the invention") includes at least a crystalline polyester resin and a colorant and shows a dielectric loss index ∈" of 0.1 or less (or about 0.1 or less) at 0.1 Hz and 500 V (also referred to hereinafter as dielectric loss index ∈" at high voltage and low frequency) at 30° C. under 90% RH.

The dielectric loss index ∈" of the toner according to the invention at high voltage and low frequency should be 0.1 or less, and is preferably 0.05 or less, but is preferably 0.01 or more.

The method of setting the dielectric loss index ∈" at high voltage and low frequency to 0.1 or less may be a method including a step in which fusion and coalescence are conducted while an acid and a surfactant is added at the time of forming a toner by an emulsion polymerization aggregation process, for example. The method of setting the dielectric loss index ∈" at high voltage and low frequency to 0.1 or less will be described in detail later.

The dielectric loss index ∈" of the toner according to the invention at 1000 Hz and 3 V at 30° C. and 90% RH (also referred to hereinafter as dielectric loss index ∈" at low voltage and high frequency) may be in the range of from 0.01 (or about 0.01) to 0.03 (or about 0.03). A toner containing a crystalline polyester resin has a problem in that a desired image density relative to the amount of colorant added is not obtained. An estimated reason for failure to achieve the desired density is supposedly that a colorant and a crystalline polyester resin selectively aggregate to lower the dispersibility of the colorant at the time of fixation. By measuring the dielectric loss index ∈" at low voltage and high frequency, the state of aggregation of a colorant and a crystalline polyester resin can be confirmed.

As described above, a dielectric loss index ∈" in the range of from 0.01 to 0.03 at low voltage and high frequency indicates that a colorant and a crystalline polyester resin are excellently dispersed without aggregation. Accordingly, a desired image density may be attained with a low amount of a colorant, and thus fogging may be suppressed. A reason for aggregation of a colorant and a crystalline polyester resin may be that since the crystalline polyester resin has crystallinity and the colorant also has crystallinity to a certain extent, they adhere selectively to each other and are unevenly distributed. That is, the uneven distribution of the colorant with the crystalline polyester resin may be suppressed by regulating the crystallinity of the crystalline polyester resin.

As described above, the dielectric loss index ∈" of the toner according to the invention at low voltage and high frequency is preferably in the range of from 0.01 to 0.03, more preferably in the range of from 0.015 to 0.025, even more preferably in the range of from 0.018 to 0.022.

The method of setting the dielectric loss index ∈" at low voltage and high frequency in the range of from 0.01 to 0.03 includes a method of reducing the crystallinity of a crystalline polyester resin by heating to a temperature in the vicinity of the melting point of the crystalline polyester resin followed by rapid cooling in preparation of a toner by an emulsion polymerization aggregation process. This method will be described in detail later.

In the invention, the dielectric loss index ∈" at high voltage and low frequency and the dielectric loss index ∈" at low voltage and high frequency are measured by compression-molding the toner into a disk shape of 50 mm in diameter and 3 mm in thickness at 98067 kPa (1000 kgf/cm$^2$) for 2 minutes, leaving the disk for 24 hours in an atmosphere at 30° C. and 90% relative humidity and determining its dielectric loss in the same atmosphere.

The measurement is conducted on the sample that is on an electrode for solid (SE-71, manufactured by Ando Electric Co., Ltd.) having a diameter of 38 mm, using a dielectric measurement system 126096W manufactured by Solartron Ltd. under the conditions of 0.1 Hz and 50 V or 1000 Hz and 3 V.

The release agent that may be used in the invention is preferably a hydrocarbon wax, since its high hydrophobicity reduces residual water in the toner, resulting in less voids.

Hereinafter, the toner according to the invention, along with the method for manufacturing the same, is described in detail.

The method for manufacturing the toner for development of an electrostatic image according to the invention (also referred to hereinafter as the method for manufacturing the toner according to the invention) includes (i) an aggregated particle forming step of mixing a resin particle dispersion liquid in which binder resin particles that contains a crystalline polyester resin are dispersed and a colorant dispersion liquid in which a colorant is dispersed and adding an aggregating agent thereto, so as to form aggregated particles, and (ii) a fusing/coalescing step of heating the aggregated particles and adding an acid and a surfactant, so as to fuse and coalesce the agoregated particles. In the aggregated particle forming step, a release agent dispersion liquid that contains a release agent may be mixed with the resin particle dispersion liquid and the colorant dispersion liquid.

In the aggregated particle forming step, it is possible to add a second resin particle dispersion liquid in which a second resin particles (binder resin) are dispersed after the formation of the aggregated particles (core aggregated particles), so as to form resin-adhered aggregated particles in which the second resin particles are adhered to the surfaces of the core aggregated particles and so as to form a toner having a core/shell structure.

When the toner having a core/shell structure is prepared, the amount of the second resin particle dispersion liquid to be used depends on the particle diameter of the resin particles contained therein, and may be selected such that the thickness of the finally obtained shell layer becomes from about 20 to about 500 nm. The amount of the second binder resin to be used, in terms of solid content, is preferably 1 to 40% by weight, more preferably 5 to 30% by weight, based on the total amount of the toner. When the thickness of the shell layer is less than 20 nm, there are cases where the colorant tends to be exposed on the surface of the toner, resulting in fogging at high temperature and high humidity. When the thickness of the shell layer is more than 500 nm, there are cases where low-temperature fixability is inhibited.

—Formation of Aggregated Particles—

From the viewpoint of chargeability and adhesion to paper at the time of fixation, the binder resin in the invention may be a polyester resin and includes at least a crystalline polyester resin. By incorporation of the crystalline polyester resin, low-temperature fixability may be attained.

In the invention, the melting point of the crystalline polyester resin may be determined as the melting peak temperature in a measurement by input compensation differential scanning calorimetry prescribed in JIS K-7121 (which is incorporated herein by reference) with a differential scanning calorimeter (DSC) at a temperature increase rate of 10° C./min. from room temperature to 150° C. There are crystalline resins that each show plural melting peaks, in which case the maximum peak is regarded as the melting point.

Now, the crystalline polyester resin used in the invention is described in detail.

The crystalline polyester resin is synthesized from an acid (dicarboxylic acid) component and an alcohol (diol) component. In the invention, the "acid-derived constituent component" refers to a moiety which was originally an acid component before synthesis of the polyester resin, and the "alcohol-derived constituent component" refers to a moiety which was originally an alcohol component before synthesis of the polyester resin.

When the polyester resin is not crystalline, that is, when the polyester resin is amorphous, toner blocking resistance and image storability may not be maintained while maintaining satisfactory low-temperature fixability. Accordingly, the "crystalline polyester resin" in the invention refers to a resin showing a clear endothermic peak rather than a stepwise change in an endothermic amount in differential scanning calorimetry (DSC). In the case of a polymer in which one or more other components are copolymerized, the copolymer is also called a crystalline polyester if the amount of such other components is 50 weight % or less with respect to the main chain of the crystalline polyester.

—Acid-Derived Constituent Component—

The acid from which the acid-derived constituent component is derived is preferably an aliphatic dicarboxylic acid, particularly preferably a linear carboxylic acid. Examples thereof include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, lower alkyl esters thereof, and acid anhydrides thereof.

The acid-derived constituent component may preferably contain constituent components such as a constituent component derived from a dicarboxylic acid having a double bond and a constituent component derived from a dicarboxylic acid having a sulfonic acid group, besides the above-mentioned constituent component derived from an aliphatic dicarboxylic acid. The scope of the constituent component derived from a dicarboxylic acid having a double bond encompasses not only a constituent component derived from a dicarboxylic acid having a double bond, but also a constituent component derived from a lower alkyl ester or acid anhydride of a dicarboxylic acid having a double bond. The scope of the constituent component derived from a dicarboxylic acid having a sulfonic acid group encompasses not only a constituent component derived from a dicarboxylic acid having a sulfonic acid group, but also a constituent component derived from a lower alkyl ester or acid anhydride of a dicarboxylic acid having a sulfonic acid group.

Since the entire resin can be crosslinked by using the double bond that the dicarboxylic acid having a double bond has, the dicarboxylic acid having a double bond is preferably used for preventing hot offset at the time of fixing. Examples of such a dicarboxylic acid include, but are not limited to, maleic acid, fumaric acid, 3-hexenedioic acid, and 3-octenedioic acid. Examples also include lower alkyl esters and anhydrides of the above-mentioned dicarboxylic acids. Among these, fumaric acid, maleic acid and the like are preferable from the viewpoint of cost.

Dicarboxylic acids having a sulfonic acid group is effective from the standpoint of dispersing a colorant, such as a pigment, well. When the entire resin is emulsified or suspended in water to prepare fine particles from the toner mother particles, the presence of a sulfonic acid group enables emulsification or suspension with a reduced amount of surfactant, as described later. Examples of such dicarboxylic acids having a sulfonic acid group include, but are not limited to, sodium 2-sulfoterephthalate, sodium 5-sulfoisophthalate, sodium sulfosuccinate, and lower alkyl esters and acid anhydrides thereof. Among them, sodium 5-sulfoisophthalate or the like is preferable from the viewpoint of productivity.

The content of other acid-derived constituent component(s) than the aliphatic dicarboxylic acid-derived constituent component (that is, the constituent component derived from a dicarboxylic acid having a double bond and/or the constituent component derived from a dicarboxylic acid having a sulfonic acid group) relative to the entire acid-derived constituent components, is preferably in the range of from 1 (or about 1) to 20 (or about 20) constituent mol %, more preferably in the range of from constituent 2 to 10 mol %. When the content is less than 1 constituent mol %, there are cases where the dispersibility of a colorant is unsatisfactory and/or the diameter of the emulsified particles is so large that the regulation of the toner diameter through aggregation is difficult. On the other hand, when the content is more than 20 constituent mol %, there are cases where the crystallinity of the polyester resin is lowered, leading to decrease in the melting point, deterioration of the storability of an image, and inability to form a latex due to an excessively small diameter of emulsified particles that allows dissolution in water. In the invention, the "constituent mol %" refers to percentage by mol based on the entire amount of the corresponding constituent component group (either the acid-derived constituent component(s) or the alcohol-derived constituent component(s)) in the polyester resin.

—Alcohol-derived Constituent Component—

The alcohol-derived constituent component may be an alipliatic diol, and examples thereof include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol and 1,20-eicosanediol.

When the alcohol-derived constituent component includes an aliphatic diol-derived constituent component, the content of the aliphatic diol-derived constituent component may be 80 constituent mol % or more, and if necessary, other components are also contained in the alcohol-derived constituent component. When the alcohol-derived constituent component is an aliphatic diol-derived constituent component, the content of the aliphatic diol-derived constituent component may be 90 constituent mol % or more. When the content of the aliphatic diol-derived constituent component is less than 80 constituent mol %, the crystallinity of the polyester resin is lowered and the melting point is lowered, resulting in deterioration of toner blocking resistance, image storability, and low-temperature fixability.

Constituent components such as a diol-derived constituent component having a double bond or a diol-derived constituent component having a sulfonic acid group are examples of other components that are optionally contained.

The diol having a double bond may be, for example, 2-butene-1,4-diol, 3-butene-1,6-diol, or 4-butene-1,8-diol.

The diol having a sulfonic acid group may be 1,4-dihydroxy-2-sulfonic acid benzene sodium salt, 1,3-dihydroxymethyl-5-sulfonic acid benzene sodium salt, and 2-sulfo-1,4-butanediol sodium salt.

When one or more other alcohol-derived constituent components than the linear aliphatic diol-derived constituent component are added, that is, when adding a diol-derived constituent component having a double bond and/or a diol-derived constituent component having a sulfonic acid group, the total content of the diol-derived constituent component having a double bond and the diol-derived constituent component having a sulfonic acid group with respect to the total amount of the alcohol-derived constituent components is preferably from 1 to 20 constituent mol %, more preferably from 2 to 10 constituent mol %.

When the content of the other alcohol-derived constituent component(s) than the aliphatic diol-derived constituent component is less than 1 constituent mol % based on the total amount of the alcohol-derived constituent components, there are cases where the dispersibility of colorant is unsatisfactory, the diameter of the emulsified particles is increased, and the regulation of the toner diameter through aggregation becomes difficult. On the other hand, when the content is more than 20 constituent mol %, there are cases where the melting point is lowered, the storage stability of an image is deteriorated, and a latex cannot be formed due to an excessively small emulsion particle diameter that allows dissolution in water.

The melting point of the binder resin according to the invention may be from 50° C. (or about 50° C.) to 120° C. (or about 120° C.), and is preferably from 60 to 110° C. When the melting point is lower than 50° C., the storage stability of the toner and the post-fixation storage stability of a toner image may be problematic. On the other hand, when the melting point is higher than 120° C., sufficient low-temperature fixability as compared with the conventional toner may not be achieved.

The method for manufacturing the crystalline polyester resin is not particularly limited, and the resin may be produced by a general polyester-polymerization method of reacting an acid component and an alcohol component, such as a direct polycondensation method or an ester exchange method. The method may be appropriately selected in accordance with the type of the monomers. The molar ratio of acid component to alcohol component (acid component/alcohol component) at reaction varies depending on the reaction conditions etc., and cannot be uniquely defined, but is usually about 1/1. Production of the polyester resin may be carried out at a polymerization temperature of 180 to 230° C.; the reaction may be carried out while removing the water and alcohol generated during the condensation and optionally reducing the pressure in the reaction system as necessary.

When the monomers do not dissolve or are not compatible with each other at the reaction temperature, a high-boiling solvent may be added as a dissolution assistant to dissolve the monomers; the dissolution assistant solvent may be distilled away during the polycondensation reaction. When there is a monomer with poor compatibility in the copolymerization reaction, the monomer with poor compatibility may be first condensed with either the acid or alcohol that is to be polycondensed with the monomer having poor compatibility, and then the condensate may be further subjected to polycondensation with major components.

Catalyst that are usable in the production of the polyester resin include alkali metal compounds such as those of sodium or lithium; alkaline earth metal compounds such as those of magnesium or calcium; metal compounds such as those of zinc, manganese, antimony, titanium, tin, zirconium, or germanium; and phosphorous acid compounds, phosphoric acid compounds and amine compounds. Specific examples thereof include sodium acetate, sodium carbonate, lithium acetate, lithium carbonate, calcium acetate, calcium stearate, manganese acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl) phosphite, ethyltriphenyl phosphonium bromide, triethylamine, and triphenylaamine.

In the emulsification step, emulsified particles (droplets) of the polyester resin may be formed by mixing an aqueous medium and a mixed solution (polymer solution) wherein the mixed solution (polymer solution) contains the polyester resin (which has optionally been subjected to sulfonation etc.) and, optionally, a colorant, and then applying a shear force to the mixed solution.

In the preparation of the resin particle dispersion liquid, when the reaction system is heated to a temperature in the range of (the melting point of the crystalline polyester resin ±5° C. (or about 5° C.)), preferably (the melting point of the crystalline polyester resin ±3° C.) so as to reduce the viscosity of the polymer liquid and so as to form emulsified particles, and then cooled to 40° C. (or about 40° C.) or less (preferably to 30° C. or less) at a rate from 6° C./min. (or about 6° C./min.) to 20° C./min (or about 20° C./min). (preferably at a rate from 10° C./min. to 16° C./min.), the crystallinity of the crystalline polyester resin is decreased, so that aggregation of the colorant particles and aggregation of crystalline polyester particles hardly occur, resulting in improved dispersibility of the colorant. As a result, the dielectric loss index ∈" at low voltage and high frequency can be set to a value within the range of from 0.01 to 0.03.

When the resin particle dispersion liquid is prepared, a dispersant may be used for stabilizing the resin particles and for thickening the aqueous medium.

When the heating temperature at the time of preparing the resin particle dispersion liquid is less than (the melting point of the crystalline polyester resin −5° C.), the crystalline polyester resin does not sufficiently melt and crystalline portions remain; as a result, there are cases where the resin is distributed and aggregated separately from the colorant at the time of preparing a toner. When the heating temperature is more than (the melting point of the crystalline polyester resin +5° C.), the viscosity of the crystalline polyester resin is reduced, and there are cases where the aggregated particles further aggregate to generate coarse powder.

In the invention, the crystalline polyester resin may be used in an amount of 2 to 20% by weight. When the content of the crystalline polyester is less than 2% by weight, there are cases where the dispersibility thereof in the toner tends to be poor, and the colorant and the crystalline polyester tend to aggregate in the toner, resulting in fogging and decrease in the colorant density. When the content of the crystalline polyester resin is more than 20% by weight, there are cases where the crystalline polyester resin tends to precipitate on the surface of the toner, leading to increased electroconductive property of the toner, an increased dielectric loss index ∈" upon application of high voltage and low frequency, and frequent fogging.

When the cooling rate is less than 6° C./min., the temperature decrease rate is low and growth of crystals of the crystalline polyester resin proceeds; therefore, in some cases, crystalline emulsified particles having high crystallinity are formed and the crystalline polyester resin is distributed and precipitated separately from the colorant during the preparation of the toner. On the other hand, when the cooling rate is more than 20° C./min., cooling with a heat exchanger may be insufficient to achieve the cooling rate, thus necessitating use of another apparatus in some cases.

The toner according to the invention may include a non-crystalline polyester resin together with the crystalline polyester resin. In the invention, only one non-crystalline resin may be used, or, alternatively, two or more non-crystalline resins may be used. The molecular weight of the noncrystalline polyester resin is not particularly limited. For example, when the high-molecular-weight component and low-molecular-weight component are synthesized respectively, as described above, the weight-average molecular weight Mw of the high-molecular-weight component is preferably in the range of from 30000 (or about 30000) to 200000 (or about 200000), more preferably in the range of from 30000 to 100000, still more preferably in the range of from 35000 to 80000. By controlling the molecular weight within this range, the noncrystalline resin may be more evenly mixed with the crystalline resin, and the separation of the crystalline resin that has once been evenly mixed with the noncrystalline resin may be prevented, whereby low-temperature fixability may be maintained.

The molecular weight of the low-molecular-weight component is desirably in the range of from 8000 (or about 8000) to 25000 (or about 25000), more preferably in the range of from 8000 to 22000, still more preferably in the range of from 9000 to 20000. By controlling the molecular weight within this range, the high-molecular-weight component is sufficiently covered at the time of coalescence, so that the crystalline resin may be prevented from being exposed on the surface of the toner, and so that fogging at high temperatures and high humidity may be suppressed.

When a mixture of the high-molecular-weight component and the low-molecular-weight component is used, the compounding ratio thereof is not particularly limited insofar as the composition ratios (molar ratios) thereof with respect to the outflow amount in GPC are in the range described above; in general the high-molecular component/low-molecular component ratio is preferably in the range of from 10/90 (or about 10/90) to 70/30 (or about 70/30), more preferably in the range of from 20/80 to 70/30, still more preferably in the range of from 25/75 to 70/30.

The high-molecular-weight component may include, as constituent monomers, an alkenylsuccinic acid or anhydride thereof and a trimellitic acid or anhydride thereof. An alkenylsuccinic acid or anhydride thereof may be more easily mixed evenly with the crystalline polyester resin because of the presence of the alkenyl group, which is highly hydrophobic. Examples of the alkenylsuccinic acid component include n-dodecenylsuccinic acid, isododecenylsuccinic acid and n-octenylsuccinic acid, as well as anhydrides, acid chlorides and C1 to C3 lower alkyl esters thereof. By incorporation of a trivalent or higher valent carboxylic acid, the high-molecular chain may form a crosslinked structure. The crosslinked structure provides effects in that the crystalline polyester resin that has once been mixed evenly with the noncrystalline resin is fixed and hardly separated, so that low-temperature fixability may be obtained.

Examples of the trivalent or higher valent carboxylic acid include hemimellitic acid, trimellitic acid, trimesic acid, mellophanic acid, prehnitic acid, pyromellitic acid, mellitic acid and 1,2,3,4-butanetetracarboxylic acid, as well as acid anhydrides, acid chlorides and C1 to C3 lower alkyl esters thereof.

A method for manufacturing the non-crystalline polyester resin, similarly to the method for manufacturing the crystalline polyester resin described above, is not particularly limited, and the non-crystalline polyester resin may be produced by a general polyester polymerization method such as those described above. As the carboxylic acid component used in synthesis of the non-crystalline polyester resin, various dicarboxylic acids mentioned in connection with the crystalline polyester resin may also be used in a similar manner. As the alcohol component, various diols used in the synthesis of the non-crystalline polyester resin may also be used; usable diols include not only the aliphatic diols mentioned in connection with the crystalline polyester resin, but also bisphenol A, bisphenol A ethylene oxide adduct, bisphenol A propylene oxide adduct, hydrogenated bisphenol A, bisphenol S, bisphenol S ethylene oxide adduct, and bisphenol S propylene oxide adduct. From the viewpoint of toner productivity, heat resistance and transparency, it is preferable to use a bisphenol S or a bisphenol S derivative such as bisphenol S ethylene oxide adduct or bisphenol S propylene oxide. The carboxylic acid component or alcohol component may contain plural components. In particular, bisphenol S has effects in improvement in heat resistance.

Now, optional crosslinking treatment of the crystalline resin, and copolymerizable components usable in the synthesis of the binder resin, are described in detail.

At synthesis of the polyester resin, one or more other components may be copolymerized, and compounds having a hydrophilic polar group may be used. Such additional compounds for polyester resin include dicarboxylic acid compounds having an aromatic ring directly substituted by a sulfonyl group such as sodium sulfonyl-terephthalate and sodium 3-sulfonyl isophthalate. When the binder resin is a vinyl resin, specific examples of additional components include unsaturated fatty carboxylic acids such as (meth) acrylic acid and itaconic acid, esters of (meth)acrylic acids and alcohols such as glycerin mono(meth)acrylate, fatty acid-modified glycidyl (meth)acrylate, zinc mono(meth)acrylate, zinc di(meth)acrylate, 2-hydroxyethyl (meth)acrylate, polyethylene glycol (meth)acrylate and polypropylene glycol (meth)acrylate, styrene derivatives having a sulfonyl group at the ortho-, meta- or para-position, and a sulfonyl group-substituted aromatic vinyl such as sulfonyl group-containing vinyl naphthalene.

A crosslinking agent may be added as necessary to the binder resin for the purpose of preventing uneven gloss, uneven coloration and hot offset, upon fixation in a high-temperature range.

Specific examples of the crosslinking agent include aromatic polyvinyl compounds such as divinyl benzene and divinyl naphthalene, aromatic polyvalent carboxylic acid polyvinyl esters such as divinyl phthalate, divinyl isophthalate, divinyl terephthalate, divinyl homophthalate, divinyl/trivinyl trimesate, divinyl naphthalene dicarboxylate and divinyl biphenyl carboxylate, divinyl esters of nitrogen-containing aromatic compounds such as divinyl pyridine dicarboxylate, unsaturated heterocyclic compounds such as pyrrole and thiophene, vinyl esters of unsaturated heterocyclic compound carboxylic acids such as vinyl pyromucate, vinyl furan carboxylate, vinyl pyrrole-2-carboxylate and vinyl thiophene carboxylate, linear polyhydric alcohol (meth)acrylates such as butane diol methacrylate, hexane diol acrylate, octane diol methacrylate, decane diol acrylate and dodecane diol methacrylate, branched, substituted polyhydric alcohol (meth) acrylates such as neopentyl glycol dimethacrylate, 2-hydroxy-1,3-diacryloxy propane, and polyvinyl esters of polyvalent carboxylates such as polyethylene glycol di(meth) acrylate, polypropylene polyethylene glycol di(meth)acrylates, divinyl succinate, divinyl fumarate, vinyl/divinyl maleate, divinyl diglycolate, vinyl/divinyl itaconate, divinyl acetone dicarboxylate, divinyl glutarate, divinyl 3,3'-thiodipropionate, divinyl/trivinyl trans-aconate, divinyl adipate, divinyl pimelate, divinyl suberate, divinyl azelate, divinyl sebacate, divinyl dodecanedioate, and divinyl brassylate.

In order to control the melting point, molecular weight etc. of the crystalline polyester resin, one or more compounds having a shorter-chain alkyl or alkenyl croup, an aromatic ring, or the like, may be used, other than the polymerizable monomers described above. Specific examples of such compounds, when the compounds are dicarboxylic acids, include alkyl dicarboxylic acids such as succinic acid, malonic acid and oxalic acid, aromatic dicarboxylic acids such as phthalic acid, isophthalic acid, terephthalic acid, homophthalic acid, 4,4'-bibenzoic acid, 2,6-naphthalene dicarboxylic acid and 1,4-naphthalene dicarboxylic acid, and nitrogen-containing aromatic dicarboxylic acids such as dipicolinic acid, dinicotinic acid, quinolinic acid and 2,3-pyrazine dicarboxylic acid; specific examples of the compounds, when the compounds are diols, include short-alkyl diols of succinic acid, malonic acid, acetone dicarboxylic acid and diglycolic acid; and specific examples of the compounds, when the compounds are short-chain alkyl vinyl polymerizable monomers, include short-chain alkyl or alkenyl (meth)acrylates such as methyl (meth)acrylate, ethyl (meth)acrylate, propyl (meth)acrylate and butyl (meth)acrylate, vinyl nitrites such as acrylonitrile and methacrylonitrile, vinyl ethers such as vinyl methyl ether and vinyl isobutyl ether, vinyl methyl ketone, vinyl ethyl ketone and vinyl isopropenyl ketone, and olefins such as ethylene, propylene, butadiene and isoprene. Only one of such polymerizable monomers may be used, or alternatively, two or more of such polymerizable monomers may be used in combination.

In the invention, a compound having a hydrophilic polar group may be used insofar as the compound can be copolymerized with the other copolymerization components in the polyester resin as a resin for an electrostatic image developing toner. Specific examples of the compound include dicarboxylic acid compounds having an aromatic ring directly substituted by a sulfonyl group such as sodium sulfonyl-terephthalate and sodium 3-sulfonyl isophthalate. When the resin is a vinyl resin, specific examples of the compound include unsaturated fatty carboxylic acids such as (meth)acrylic acid and itaconic acid, esters of (meth)acrylic acids and alcohols such as glycerin mono(meth)acrylate, fatty acid-modified glycidyl (meth)acrylate, zinc mono(meth)acrylate, zinc di(meth)acrylate, 2-hydroxyethyl (meth)acrylate, polyethylene glycol (meth)acrylate and polypropylene glycol (meth)acrylate, styrene derivatives having a sulfonyl group at the ortho-, meta- or para-position, and a sulfonyl group-substituted aromatic vinyl such as sulfonyl group-containing vinyl naphthalene.

The colorant used in the toner according to the invention may be selected, for example, from the following pigments.

Exemplary yellow pigments include chrome yellow, zinc yellow, yellow iron oxide, cadmium yellow, chrome yellow, Hansa yellow, Hansa yellow 10G benzidine yellow G, benzidine yellow GR, threne yellow, quinoline yellow, and permanent yellow NCG. Specific examples include C.I. Pigment Yellow 74, C.I. Pigment Yellow 180, and C.I. Pigment Yellow 93, among which C.I. Pigment Yellow 74 is preferable from the viewpoint of pigment dispersibility.

Exemplary black pigments include carbon black, copper oxide, manganese dioxide, aniline black, active carbon, non-magnetic ferrite, and magnetite.

Exemplary orange pigments include reddish chrome yellow, molybdenum orange, permanent orange GTR, pyrazolone orange, Balkan orange, benzidine orange GG, indanthrene brilliant orange RK, and indanthrene brilliant orange GK.

Exemplary red pigments include red iron oxide, cadmium red, red lead, mercury sulfide, watching red, permanent red 4R, Lysol red, brilliant carmine 3B, brilliant carmine 6B, DuPont oil red, pyrazolone red, rhodamine B lake, lake red C, rose bengal, eosin red, and alizarin lake.

Exemplary blue pigments include iron blue, cobalt blue, alkaline blue lake, Victoria blue lake, fast sky blue, indanthrene blue BC, aniline blue, ultramarine blue, calco oil blue, methylene blue chloride, phthalocyanine blue, phthalocyanine green, and malachite green oxalate.

Exemplary violet pigments include manganese violet, fast violet B, and methyl violet lake.

Exemplary green pigments include chromium oxide, chrome green, pigment green, malachite green lake, and final yellow green G.

Exemplary white pigments include Chinese white, titanium oxide, antimony white, and zinc sulfide.

Exemplary extender pigments include barite powder, barium carbonate, clay, silica, white carbon, talc, and alumina white.

As necessary, a dye may be used as the colorant. Examples of the dye include various dyes such as basic, acidic, disperse or direct dyes, and specific examples include nigrosine, methylene blue, rose bengal, quinoline yellow, and ultramarine blue. Only one dye may be used, or a mixture or solid solution of two or more dyes may be used.

The colorant used in the invention may be carbon black. The carbon black to be used may be a known carbon black. Examples thereof include furnace black, channel black, acetylene black and thermal black.

In the invention, carbon black has an average primary particle diameter of preferably 20 nm (or about 20) nm to 50 nm (or about 50 min), more preferably 25 to 47 nm, desirably 35 to 45 nm. When the average primary particle diameter is less than 20 nm, there are cases where the carbon black tends to be exposed on the toner surface due to difficulty in inclusion of the carbon black in the toner, resulting in reduction in the electric resistance of the toner and in the quantity of charge. On the other hand, when the average primary particle diameter of the carbon black is larger than 50 nm, there are cases where the carbon black fails to provide satisfactory coloring power even when excellently dispersed. If a large amount of carbon black having a large primary particle diameter is added to the toner for the purpose of increasing the color density, there are cases where the carbon black may not be sufficiently incorporated into the toner and thus the carbon black tends to be exposed on the surface of the toner.

In the case of a color toner, brightens L* is preferably higher in the invention. When the brightness L* is low, the resulting image may be dark and may be obscure.

These colorants may be dispersed by a known method. Apparatuses may be used, such as a rotary shearing type homogenizer, media dispersing machines such as a ball mill, a sand mill and an attriter, and dispersing machines such as a high pressure counter collision type dispersing machine.

These colorants may be dispersed in an aqueous system with a polar surfactant by a homogenizer such as those described above.

The colorant used in the invention may be selected from the viewpoint of hue angle, chroma saturation, brightness, weatherability, and dispersibility in the toner. The colorant may be added in an amount of 1 to 15 parts by weight relative to 100 parts by weight of the binder resin. Unlike other colorants, when a magnetic material is used as a black colorant, the amount thereof to be added may be in an amount of 30 to 100 parts by weight relative to 100 parts by weight of the binder resin.

In the invention, the amount of the colorant contained in the toner is preferably 4 to 15% by weight. When the amount of the colorant contained in the toner is less than 4%, the colorant concentration is low in a fixed image, which may lead to lowered coloring properties. When the amount of the colorant contained in the toner is more than 15%, the colorant tends to be exposed on the surface in some cases.

Specific examples of the release agent that may be used in the invention include low-molecular weight polyolefines such as polyethylene, polypropylene, and polybutene; silicones each having a softening point; fatty acid amides such as oleamide, erucamide, ricinoleamide, and stearamide; vegetable waxes such as carnauba wax, rice wax, candelilla wax, Japan wax, and jojoba oil; animal waxes such as beeswax; mineral/petroleum waxes such as montan wax, ozokerite, ceresin, paraffin wax, microcrystalline wax, and Fischer-Tropsch wax; ester waxes from a higher fatty acid and a higher alcohol such as stearyl stearate and behenyl behenate; ester waxes from a higher fatty acid and a monohydric or polyhydric lower alcohol such as butyl stearate, propyl oleate, glyceride monostearate, glyceride distearate, and pentaerythritol tetrabehenate; ester waxes consisting of a higher fatty acid and a polyhydric alcohol multimer such as diethylene glycol monostearate, dipropylene glycol distearate, diglyceride distearate, and triglyceride tetrastearate; sorbitan higher fatty acid ester waxes such as sorbitan monostearate; and cholesterol higher fatty acid ester waxes such as cholesteryl stearate.

The release agent that may be used in the invention is preferably a hydrocarbon wax, more preferably a hydrocarbon wax having a melting point in the range of from (the melting point of polyester crystalline resin +10° C.) to (the melting point of polyester crystalline resin +25° C.). The hydrocarbon wax has a structure of a hydrocarbon, and thus has a lower affinity for the crystalline polyester resin than a release agent having a polar group; therefore, the hydrocarbon wax may suppress selective aggregation and may improve the dispersibility of the release agent and the crystalline polyester resin. Due to the improved dispersibility of the crystalline polyester resin, the dispersibility of the colorant in the toner may be improved, and development may be conducted with less fogging even at high temperature and high humidity. Examples of the hydrocarbon wax include polyethylene wax, Fischer Tropsch wax, and microcrystalline wax.

The hydrocarbon wax preferably has a peak of an endothermic profile determined by differential thermal analysis in the range of from 85° C. (or about 85° C.) to 95° C. (or about 95° C.). When the peak of the endothermic profile of the hydrocarbon wax is less than 85° C., blocking of toner particles tend to occur at high temperature and high humidity in some cases. When the peak of the endothermic profile is more than 95° C., the release agent hardly fuses at high-speed fixation in some cases. It is more preferable that the proportion of the area defined by the endothermic profile of 85° C. or less to area defined by the entire endothermic profile is from 5% (or about 5%) to 15% (or about 15%). When the proportion is less than 5%, there are cases where the release agent is not fused with the non-crystalline resin upon fusion in the preparation of the toner, resulting in rejection and poor releasability at the time of fixation. When the proportion is more than 15%, there are cases where blocking of toner particles easily occurs at high temperature and high humidity. It is more preferable that the content of the release agent in the toner determined from the height of the peak of the endothermic profile is from 6% (or about 6%) to 15% (or about 15%) by weight. When the amount of the release agent in the toner is less than 6% by weight, the amount of release agent may not be sufficient for providing the intended effects. When the amount of release agent is more than 15% by weight, there are cases where the release agent is not be incorporated by an aggregation coalescing process and is fused to the surface of the toner, frequently causing blocking of toner particles at high temperature and high humidity.

It is preferable that the viscosity of the release agent at 140° C. determined with an E type viscometer equipped with a cone plate with a cone angle of 1.34 degrees is in the range of from 1.50 mPa·s (or about 1.50 mPa·s) to 5.0 mPa·s (or about 5.0 mPa·s) (more preferably 2.5 to 4.0 mPa·s). When the viscosity is less than 1.5 mPa·s, there are cases where the viscosity of the release agent is low at the time of toner coalescing, and thus the release agent is unevenly distributed in the toner and unevenly exuded at the time of fixation. When the viscosity is more than 5.0 mPa·s, there are cases where the viscosity of the release agent is high at the time of high-speed fixation, causing insufficient exudation of the release agent at the time of fixation.

In production of the toner according to the invention, a surfactant may be used for the purpose of, for example, stabilizing the dispersion status of the resin particle dispersion liquid, the colorant dispersion liquid and the release agent dispersion liquid, in the emulsion polymerization aggregation process.

Examples of the surfactant include anionic surfactants, such as sulfuric ester salts surfactants, sulfonate surfactants, phosphoric ester surfactants, and soap surfactants, cationic surfactants, such as amine salt surfactants and quaternary ammonium salt surfactants, and nonionic surfactants, such as polyethylene glycol surfactants, alkylphenol ethylene oxide adduct surfactants, and polyhydric alcohol surfactants. Among them, ionic surfactants are preferable, and anionic surfactants and cationic surfactants are more preferable.

In the toner according to the invention, an anionic surfactant generally has a strong ability to disperse and is excellent in dispersing resin particles and a colorant; therefore it is advantageous to use an anionic surfactant as a surfactant for dispersing the release agent.

The nonionic surfactant may be used together with an anionic surfactant or a cationic surfactant. Only one surfactant may be used, or two or more surfactants may be used in combination.

Specific examples of the anionic surfactant include fatty acid soaps such as potassium laurate, sodium oleate, and castor oil sodium salt; sulfuric acid esters such as octyl sulfate, lauryl sulfate, lauryl ether sulfate, and nonylphenyl ether sulfate; lauryl sulfonate, dodecylbenzene sulfonate, and sodium alkylnaphthalene sulfonates such as, triisopropylnaphthalene sulfonate and dibutylnaphithalene sulfonate; sulfonate salts such as naphthalene sulfonate formalin condensates, monooctyl sulfosuccinates, dioctyl sulfosuccinates, lauramide sulfonates, and oleamide sulfonates; phosphoric esters such as lauryl phosphate, isopropyl phosphate, and nonylphenyl ether phosphate: dialkyl sulfosuccinate salts such as sodium dioctyl sulfosuccinate; sulfosuccinate salts such as disodium lauryl sulfosuccinate.

Specific examples of the cationic surfactant include amine salts such as lauryl amine hydrochloride, stearyl amine hydrochloride, oleyl amine acetate, stearyl amine acetate, and stearylaminopropyl amine acetate, and quaternary ammonium salts such as lauryltrimethyl ammonium chloride, dilauryldimethyl ammonium chloride, distearyldimethyl ammonium chloride, distearyldimethyl ammonium chloride, lauryl dihydroxy ethylmethyl ammonium chloride, oleyl-bis-polyoxyethylenemethyl ammonium chloride, lauroyl aminopropyl dimethylethyl ammonium ethosulfate, lauroyl aminopropyl dimethylhydroxyethyl ammonium perchlorate, alkylbenzene trimethyl ammonium chloride, and alkyltrimethyl ammonium chloride.

Specific examples of the nonionic surfactant include alkyl ethers such as polyoxyethylene octyl ether, polyoxyethylene lauryl ether, polyoxyethylene stearyl ether, and polyoxyethylene oleyl ether; alkyl phenyl ethers such as polyoxyethylene octylphenyl ether and polyoxyethylene nonylphenyl ether; alkyl esters such as polyoxyethylene laurate, polyoxyethylene stearate, and polyoxyethylene oleate; alkyl amines such as polyoxyethylene lauryl amino ether, polyoxyethylene stearyl amino ether, polyoxyethylene oleyl amino ether, polyoxyethylene soy bean amino ether, and polyoxyethylene beef tallow amino ether; alkyl amides such as polyoxyethylene lauramide, polyoxyethylene stearamide, and polyoxyethylene oleamide; vegetable oil ethers such as polyoxyethylene castor oil ether and polyoxyethylene rapeseed oil ether; alkanol amides such as lauric acid diethanol amide, stearic acid diethanol amide, and oleic acid diethanol amide; and sorbitan ester ethers such as polyoxyethylene sorbitan monolaurate, polyoxyethylene sorbitan monopalmitate, polyoxyethylene sorbitan monostearate, and polyoxyethylene sorbitan monooleate.

The content of the surfactant in each dispersion liquid may be such a content as not to hinder the invention, and is generally small. Specifically, the content is preferably from 0.01 to 10% by weight, more preferably from 0.05 to 5% by weight, still more preferably from 0.1 to 2% by weight. If the content is less than 0.01% by weight, since the respective dispersion liquids such as the resin particle dispersion liquid, the colorant dispersion liquid, and the release agent dispersion liquid are unstable, aggregation may occur and separation of specific particles may occur due to the difference in stability between the respective particles during aggregation. If the content is more than 10% by weight, the particle size distribution of the particles may be broadened, or the control of the particle diameter may be difficult. In general, a suspension polymerization toner dispersion having a large particle size is stable even with a small amount of surfactant.

In addition, it is possible to use an aqueous polymer that is solid at normal temperature. Specifically, usable aqueous polymers include cellulose compounds such as carboxymethyl cellulose and hydroxypropyl cellulose, polyvinyl alcohol, gelatin, starch, and gum arabic.

The dispersing medium for the resin particle dispersion liquid, the colorant dispersion liquid, the release agent dispersion liquid and other components in the invention may be, for example, an aqueous medium.

Examples of the aqueous medium include water such as distilled water and ion exchange water, and alcohols. Only one aqueous medium may be used, or, alternatively, two or more aqueous media may be used in combination.

When the emulsion-polymerization aggregation process is used in the production of the toner according to the invention, aggregation may be caused by changing the pH in the aggregation step, to form particles. At the same time, an aggregating agent may be added in order to cause stable and rapid aggregation or in order to obtain aggregated particles having a narrower particle-size distribution.

The aggregating agent may be a compound having monovalent or multivalent electric charges. Specific examples of such a compound include the above-mentioned water-soluble surfactants such as ionic surfactants and nonionic surfactants; acids such as hydrochloric acid, sulfuric acid, nitric acid, acetic acid, and oxalic acid; metallic salts of inorganic acids, such as magnesium chloride, sodium chloride, aluminum sulfate, calcium sulfate, ammonium sulfate, aluminum nitrate, silver nitrate, copper sulfate, and sodium carbonate; metallic salts of aliphatic or aromatic acids, such as sodium acetate, potassium formate, sodium oxalate, sodium phthalate, and potassium salicylate; metallic salts of phenols, such as sodium phenolate; metallic salts of amino acids; and inorganic acid salts of aliphatic or aromatic amines, such as triethanol amine hydrochloride and aniline hydrochloride.

In consideration of the stability of the aggregated particles, the stability of the aggregating agent against heat and lapse of time, the ease of removal during cleaning and the like, the aggregating agent is preferably a metal salt of inorganic acid in respect of performance and use. Specific examples include metallic salts of inorganic acids, such as magnesium chloride, sodium chloride, aluminum sulfate, calcium sulfate, ammonium sulfate, aluminum nitrate, silver nitrate, copper sulfate, and sodium carbonate.

The amount of aggregating agent to be added varies depending upon the valence of the charge, and may be small. The amount of aggregating agent may be 3% by weight or less for monovalence, 1% by weight or less for divalence, and 0.5% by weight or less for trivalence. Because the amount of the aggregating agent is preferably smaller, use of a polyvalent compound is preferable.

—Fusing/Coalescing Step—

In the fusing/coalescing step in the method for manufacturing the toner according to the invention, it is important that the aggregated particles are heated preferably to a temperature in the vicinity of the melting point of the crystalline polyester resin (specifically to a temperature within the range of from the melting point of the crystalline polyester resin −10 to the melting point of the crystalline polyester resin +5° C.) and are fused and coalesced while an acid and a surfactant are added. In a usual fusing/coalescing step, it is necessary to conduct fusion and coalescence under high pH in order to avoid deterioration in the particle-size distribution caused by formation of coarse powder due to aggregation of toner particles. However, the addition of an acid together with a surfactant allows the fusion and coalescence to be conducted under a lowered pH without causing aggregation of toner particles, while suppressing generation of coarse powder, whereby fusion and coalescence may be conducted even at low temperatures.

In conventional techniques, the reaction system is hydrophilic due to its high pH state. Therefore, when fusion and coalescence is conducted at a temperature higher than (melting point +5° C.), the fluidity of the crystalline resin in an aggregate is lowered, and water is incorporated into that part, so that the toner particles include water. Although the water is removed by drying, voids are formed in some cases. When fusion is carried out at a temperature lower than (melting point −10° C.), the temperature is so low that fusion takes a lot of time, which may result in a lower productivity in some cases.

The addition ratio of surfactant to acid in terms of molar ratio is preferably from 0.1 to 0.7, more preferably from 0.3 to 0.6, even more preferably from 0.4 to 0.5. When this addition ratio is less than 0.1, although carboxyl ions on the surface are increased to advance fusion, the repulsion of the aggregates away from each other is weakened, leading to formation of coarse powder in some cases. On the other hand, when the addition ratio is higher than 0.7, since the amount of the surfactant adhering to the surface of the toner is increased, chargeability may be lowered and fogging may be generated at high temperature and high humidity. When the addition ratio is in the range of from 0.1 to 0.7, since the repulsion of the aggregates is suppressed while carboxyl ions may be increased, fusion proceeds without generating course powder, and a toner with less voids may be obtained. The acid to be used in the above process is not particularly limited, and examples thereof include, but are not limited to, nitric acid, sulfuric acid, acetic acid, phosphoric acid, oxalic acid, malonic acid, succinic acid, glutaric acid, adipic acid, pimelic acid, suberic acid, azelaic acid, sebacic acid, maleic acid, fumaric acid, phthalic acid, isophthalic acid, terephthalic acid, citric acid, malic acid, trimellitic acid, acrylic acid, methacrylic acid, fumaric acid, maleic acid, and cinnamic acid, among which nitric acid is preferable.

The surfactant used in the above process is not particularly limited, and examples thereof include, but are not limited to, an anionic surfactant, a cationic surfactant, a nonionic surfactant and an amphoteric surfactant. In particular, a combination of nitric acid and an anionic surfactant is preferable from the viewpoint of suppression of aggregation of toner particles, since the interaction between nitric acid and carboxyl ions may be suppressed due to the fact that an anionic portion of the anionic surfactant is easily adsorbed to nitric acid. The anionic surfactant to be used in this case may be selected from those anionic surfactants mentioned above that are usable for stabilizing the dispersion state of the resin particle dispersion liquid, the colorant dispersion liquid and the release agent dispersion liquid in the emulsion polymerization aggregation process.

—Washing Step, Drying, Step, etc.—

After the fusing and coalescing step is finished, desired toner particles are obtained through an arbitrary washing step, solid/liquid separation step and drying step. In consideration of charging properties, the washing step may include sufficient washing by replacement with ion-exchange water. The solid/liquid separation step is not particularly limited. From the viewpoint of productivity, filtration under suction, filtration under pressure etc. are preferable. The drying step is not particularly limited, either. From the viewpoint of productivity, freeze drying, flash jet drying, fluidizing drying, vibration fluidizing drying etc. are preferably used. As necessary, additives selected from the various external additives described above may be added to the toner particles after drying.

When the toner according to the invention is used as a magnetic toner, magnetic powder may be contained therein. Such magnetic powder is made of a substance that is magnetized in a magnetic field, and examples thereof include ferromagnetic powder of, for example, iron, cobalt, or nickel or powder of a compound such as ferrite or magnetite. In particular, since a toner is formed in an aqueous layer in the present invention, the ability of the magnetic material to be distributed to the aqueous layer is important; it is preferable to conduct a surface modification, for example hydrophobizing treatment, on the toner.

The toner according to the invention has a shape factor (SF1) in the range of $120 \leqq SF1 \leqq 140$ wherein the toner shape factor $SF1=(\pi/4)\times(L^2/A)\times 100$ wherein L represents the maximum length and A represents a protected area. When SF1 is less than 120, the blade cleanability of the non-transferred toner remaining on the photoreceptor may be deteriorated. When SF1 is more than 140, the fluidity of the toner may be lowered, and the transferability may be adversely affected from the beginning, The toner according to the invention may have at least one kind of metal oxide particles on a surface thereof. Specific examples of the metal oxide in the metal oxide particles include silica, titania, zinc oxide, strontium oxide, aluminum oxide, calcium oxide, magnesium oxide, cerium oxide, and composite oxides thereof. Among these materials, silica and titania are preferable from the viewpoint of particle size, particle size distribution, and productivity. Specifically, a coupling treatment with silane, titanate, aluminate, or the like may be conducted.

The coupling agent used in the coupling treatment is not particularly limited, and examples thereof include, but are not limited to, silane coupling agents such as methyltrimethoxy silane, phenyltrimethoxy silane, methylphenyldimethoxy silane, diphenyldimethoxy silane, vinyltrimethoxy silane, γ-aminopropyltrimethoxy silane, γ-chloropropyltrimethoxy silane, γ-bromopropyltrimethoxy silane, γ-glycidoxypropyltrimethoxy silane, γ-mercaptopropyltrimethoxy silane, γ-ureidopropyltrimethoxy silane, fluoroalkyltrimethoxy silane and hexamethyl disilazane; titanate coupling agents: and aluminate coupling agents.

As necessary, it is possible to add to the toner according to the invention other components (particles) such as internal additives, charge regulators, organic particles, lubricants and abrasives in addition to the resin, the colorant and the release agent.

Examples of the internal additives include magnetic substances such as metals and alloys (e.g., ferrite, magnetite, reduced iron, cobalt, manganese and nickel), and compounds including such metals. These materials may be used in such an amount as not to impair the chargeability as a toner characteristic.

The charge regulator is not particularly limited. For example, when a color toner is used, a colorless or light-colored charge control agent may be used. Examples thereof include a quaternary ammonium salt compound, a nigrosine-based compound, and a dye made of a complex of aluminum, iron or chromium, and a tripheylmethane-based pigment.

Usable organic particles include any kind of particles used ordinarily as an external additive for the toner surface, such as a vinyl based resin, a polyester resin or a silicone resin. Such inorganic or organic particles may be used as a flowability auxiliary agent, a cleaning auxiliary agent or the like.

Examples of the lubricating agents include aliphatic amides such as ethylene bisstearic amide and oleamide, and aliphatic metal salts such as zinc stearate and calcium stearate.

Examples of the abrasives include the above-mentioned silica, alumina, and cerium oxide.

When the binder resin, the colorant and the release agent are mixed, the content of the colorant in the mixture is preferably 50% by weight or less, more preferably in the range of from 2 to 40% by weight.

The content of the above-mentioned additional components may be in such a content as not to impair the objects of the invention, and is generally very low, for example in the range of from 0.01 to 5% by weight, preferably in the range of from 0.5 to 2% by weight.

An external additive containing hydrophobic silica having a primary particle diameter of 5 nm (or about 5 nm) to 20 nm (or about 20 nm) may be added externally to the toner according to the invention. By allowing hydrophobic silica to be present as an external additive on the surface of the toner, the surface area of the toner may be reduced and the hygroscopic property of the toner may be regulated. By the presence of hydrophobic silica, precipitation of highly hydrophilic ions may be controlled, thereby further regulating the hygroscopic property of the toner. By regulating the hygroscopic property of the toner, the chargeability of the toner may be maintained and fogging may be further reduced. Examples of the hydrophobic silica include dimethyldichlorosilane, trimethylchlorosilane, methyltrichlorosilane, allylphenyldichlorosilane, benzyldimethylchlorosilane, bromomethyldimethylchlorosilane, p-chlorophenyltrichlorosilane, 3-chloropropyltrimethoxysilane, vinyltriethoxysilane, vinyltriacetoxysilane, divinylchlorosilane, and hexamethylene disilazane.

The volume-average particle diameter of the toner according to the invention may be in the range of from 3 to 9 μm. When the volume-average particle diameter is less than 3 μm, chargeability tends to be insufficient and fogging may occur at high temperature in high humidity. When the volume-average particle diameter is more than 9 μm, the uniformity of an image may be lowered and the density of the image may be uneven. The particle size distribution index, in terms of volume average particle size distribution index GSDv, may be 1.30 or less, and the ratio of the number average particle size distribution index GSDp to the volume average particle size distribution index GSDv (GSDp/GSDv) may be 0.95 or more. When the volume average particle size distribution index GSDv is more than 1.30, the unevenness on the fixed image may be increased to generate uneven image density in some cases. When the ratio of the number average particle size distribution index GSDp to the volume average particle size distribution index GSDv is less 0.95, since there are an increased amount of toner particles having a smaller diameter and the amount of release agent contained in each toner particle tends to be uneven, a necessary image density is not obtained in some cases due to insufficient release.

The surface area of the toner according to the invention is not particularly limited, and may be adequately selected within the range usable in ordinary toners. Specifically, the surface area as determined by the BET method is preferably in the range of from 0.5 to 10 $m^2/g$, more preferably in the range of from 1.0 to 7 $m^2/g$, still more preferably in the range of from 1.2 to 5 $m^2/g$. The surface area of the toner is further more preferably in the range of from about 1.2 to about 3 $m^2/g$.

The dispersibility of the colorant in the invention can be confirmed by observing a section of the toner.

This observation with TEM is carried out in the following manner.

First, a treatment for embedding the toner is conducted. Specifically, 7 g bisphenol A liquid epoxy resin (Asahi Kasei Chemical) and 3 g of a curing agent ZENAMID 250 (Henkel Japan) are gently mixed, and then further mixed with 1 g of the toner. The resultant mixture is left and solidified to prepare a sample for cutting. Then, this sample for cutting, embedded at −100° C., is cut with a cutting device LEICA ultra-microtome (model number: ULTRACUT UCT, manufactured by Hitachi High Technologies) equipped with a diamond knife (model number: Type Cryo, manufactured by DIATOME), to give a sample for observation.

A section of the toner is observed with a high-resolution field emission scanning electron microscope (S-4800, manufactured by Hitachi High Technologies) equipped with a transmission electron detector. The observation is conducted at a 5000- and 10000-fold magnification.

In the invention, voids in the toner are confirmed by observing a section of the toner with SEM. In observation of the section of the toner with TEM, voids are broken upon cutting with a diamond knife and thus are hardly observable. Thus, the voids are observed in the following manner.

First, a treatment for embedding the toner is conducted. Specifically, 7 g bisphenol A liquid epoxy resin (Asahi Kasei Chemical) and 3 g of a curing agent ZENAMID 250 (Henkel Japan) are gently mixed, then mixed with 1 g of the toner. The resultant mixture is left and solidified to prepare a sample. Then, this sample is dipped in liquid nitrogen and a cut is made in the sample with a cutter. The sample is then divided into halves by hammering with a plastic hammer. A section of the sample is examined under a scanning electron microscope (S-4800, manufactured by Hitachi High Technologies) to observe voids in a section of the toner. At this time, the sample is observed at a 5000- and 10000-fold magnification.

<Electrostatic Image Developer>

The electrostatic image developer according to the invention (hereinafter, referred to sometimes as "developer according to the invention") includes a toner, wherein the toner is the above-described toner according to the invention.

The developer according to the invention is not particularly limited as long as it contains the toner according to the invention, and the developer may have a suitable composition depending on the purpose. The developer according to the invention may be a 1-component developer when the toner according to the invention is used alone, or may be a 2-component developer when the toner according to the invention is used in combination with a carrier.

For example, when a carrier is used, the carrier is not particularly limited, and carriers known per se can be mentioned. Examples include known carriers such as resin-coated carriers disclosed in JP-A No. 62-39879 and JP-A No. 56-11461.

Specific examples of the carrier include the following resin-coated carriers. The magnetic particles of the carrier may be, for example, a shaped product of usual iron powder, ferrite or magnetite, and the volume-average particle diameter thereof may be in the range of from about 30 to about 200 μm.

Examples of coating resin of the resin-coated carrier include homopolymers of styrenes such as styrene, parachlorostyrene and α-methyl styrene; α-methylene fatty acid monocarboxylates such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acryls, such as dimethyl aminoethyl methacrylate; vinyl nitrites such as acrylonitrile and methacrylonitrile; vinyl pyridines such as 2-vinyl pyridine and 4-vinyl pyridine; vinyl ethers such as vinyl methyl ether and vinyl isobutyl ether; vinyl ketones such as vinyl methyl ketone, vinyl ethyl ketone, and vinyl isopropenyl ketone; olefins such as ethylene and propylene; and fluorine-containing vinyl monomers, such as vinylidene fluoride, tetrafluoroethylene, and hexafluoroethylene; copolymers containing two or more monomers which may be selected from the above; silicone resins such as methyl silicone and methylphenyl silicone; polyesters containing bisphenol or glycol; epoxy resins; polyurethane resins; polyamide resins; cellulose resins; polyether resins; and polycarbonate resins. Only one resin may be used for coating, or two or more resins may be used for coating. The coating amount of the coating resin is preferably in the range of from about 0.1 to about 10 parts by weight, more preferably 0.5 to 3.0 parts by weight, based on 100 parts by weight of the nuclear particles.

The developer according to the invention may be a 2-component developer containing a carrier, wherein the carrier may be a magnetic particle coated with a resin having a basic carbon black dispersed therein. When an acidic or neutral carbon black is used or when carbon black is not used, the hygroscopic property of the carrier is enhanced, and electrification property upon friction with the toner may be decreased. However, the hygroscopic property of a basic carbon black is low. Accordingly, when a carrier coated with a resin having a basic carbon black dispersed therein is used, hygroscopic property is decreased even at high temperature and high humidity. That is, the frictional electrification between the toner and carrier may be maintained even at high temperature and high humidity, and fogging may be further reduced. The amount of the basic carbon black dispersed in the coating layer may be from 0.2 to 5.

The amount of the coating resin may be in the range of from 0.1 to 10 parts by weight, preferably 0.5 to 3.0 parts by weight, relative to 100 parts by weight of the magnetic particles. For production of the carrier, a heating kneader, a heating Herschel mixer, an UM mixer etc. may be used, and a heating fluidized rolling bed, a heating kiln etc. may be used depending on the amount of the coating resin. The toner/carrier mixing ratio in the electrostatic image developer is not particularly limited, and may be suitably selected depending on the purpose.

The mixing ratio of the toner according to the invention to the carrier in the developer according to the invention is not particularly limited, and may be selected suitably according to the purpose.

<Image Forming Apparatus>

Now, the image forming apparatus according to the invention using the toner (developer) according to the invention will be explained.

The image forming apparatus according to the invention includes an image holding member, a charging unit that charges the image holding member, an exposure unit that forms an electrostatic latent image on the image holding member that has been charged with the charging unit, a developing unit that develops the electrostatic latent image formed on the surface of the image holding member with a developer to form a toner image, a transfer unit that transfers the toner image formed on the image holding member onto an image receiving member (member to which the toner image is to be transferred), and a fixing unit that fixes the toner image transferred onto the image receiving member, wherein the developer according to the invention is used as the developer.

The image forming apparatus according to the invention may be combined with known steps used in electrophotographic image forming apparatuses, in addition to the units described above. The image forming apparatus according to the invention may include, for example, a cleaning unit that cleans a residual toner remaining on the surface of the image holding member after the transfer step and recovers the toner. The apparatus may further include a toner recycle unit that reutilizes, as a developer, the residual toner recovered by the cleaning unit.

In the image forming apparatus, for example, the part containing the developing unit may have a cartridge structure (process cartridge) attachable to, and detachable from, the main body of the image forming apparatus. The process cartridge includes at least a developer holder. The process cartridge may be a process cartridge according to the invention that accommodates the electrostatic image developer according to the invention.

Hereinafter, an example of the image forming apparatus according to the invention is described. However, the example should not be construed as limiting the invention. Principal parts shown in the figure are described, and description of other parts is omitted.

FIG. 1 is a schematic constitutional view showing a full-color image forming apparatus in a 4-tandem system. The image forming apparatus shown in FIG. 1 is provided with first to fourth electrophoto graphic image forming units 10Y, 10M, 10C, and 10K (image forming means) outputting an image of each color of yellow (Y), magenta (M), cyan (C) and black (K) based on color-separated image data. These image forming units (hereinafter referred to simply as "units") 10Y, 10M, 10C, and 10K are horizontally arranged with a predetermined distance therebetween. The units 10Y; 10M, 10C and 10K may be process cartridges attachable to, and detachable from, the main body of the image forming apparatus.

Above (in the figure) the respective units 10Y, 10M, 10C and 10K, an intermediate transfer belt 20 as an intermediate transfer member is disposed to extend through the respective units. The intermediate transfer belt 20 is wound around a driving roller 22 and support roller 24 in contact with the inner surface of the intermediate transfer belt 20. The rollers 22 and 24 are disposed from the left to right in the figure, and are apart from each other. The intermediate transfer belt 20 runs in the direction from the first unit 10Y to the fourth unit 10K. The support roller 24 is pressed by a spring or the like (not shown) to a direction away from the driving roller 22, so that a predetermined tension is applied to the intermediate transfer belt 20 wound around the two rollers. An intermediate transfer member cleaning unit 30 is provided at the image-holding side of the intermediate transfer belt 20, and the intermediate transfer member cleaning unit 30 faces the driving roller 22.

Developing units (developing devices) 4Y; 4M, 4C and 4K for the respective units 10Y, 10M, 10C and 10K can be supplied with 4-color (yellow, magenta, cyan, black) toners accommodated in toner cartridges 8Y, 8M, 8C and 8K, respectively.

Since the first to fourth units 10Y, 10M, 10C and 10K have similar constitutions, only the first unit 10Y for forming a yellow image, which is arranged upstream in the direction of the running direction of the intermediate transfer belt, is described as a representative unit. In the second to fourth units, members that are equivalent to the members in the first unit 10Y are provided with reference characters having the characters M (magenta), C (cyan), and K (black), respectively, in place of Y (yellow), and descriptions of the second to fourth units 10M, 10C and 10K are omitted.

The first unit 10Y has a photoreceptor 1Y acting as an image holding member. Around the photoreceptor 1Y, provided are a charging roller (charging unit) 2Y that charges the surface of the photoreceptor 1Y to a predetermined voltage, an exposure apparatus (exposure unit) 3 that exposes the charged surface to a laser light 3Y based on color-separated image signals to form an electrostatic image, a developing apparatus (developing unit) 4Y that develops the electrostatic image by supplying a charged toner to the electrostatic image, a primary transfer roller 5Y (primary transfer unit) that transfers the developed toner image onto the intermediate transfer belt 20, and a photoreceptor cleaning unit 6Y that removes a toner remaining on the surface of the photoreceptor 1Y after primary transfer, in this order.

The primary transfer roller 5Y is arranged at the inner surface side of the intermediate transfer belt 20, at a position opposite to the photoreceptor 1Y. Each of primary transfer rollers 5Y 5M, 5C and 5K is connected to a bias power source (not shown) that applies primary transfer bias. Each of the bias power sources changes the transfer bias applied to the corresponding primary transfer roller, according to control by a control part (not shown).

Hereinafter, the operation for forming a yellow image in the first unit 10Y is described. First, the surface of the photoreceptor 1Y is charged to a voltage of about −600 V to about −800 V with a charging roller 2Y, prior to operation.

The photoreceptor 1Y is formed by providing a photosensitive layer on an electroconductive substrate (volume resistivity at 20° C.: $1\times10^{-6}$ Ωcm or less). This photosensitive layer is usually highly electrically-resistant (with approximately the same level of resistance as that of a general resin), but upon irradiation with laser beam 3Y changes the specific resistance of the portion irradiated with the laser beam. According to image data for yellow sent from a control part (not shown), the layer beam 3Y is radiated from the exposure device 3 onto the surface of the charged photoreceptor 1Y. The photosensitive layer on the surface of the photoreceptor 1Y is irradiated with the laser beam 3Y so that an electrostatic image in a yellow print pattern is formed on the surface of the photoreceptor 1Y.

An electrostatic image is an image formed on the surface of the photoreceptor 1Y by electrification, and is a so-called negative latent image. The electrostatic image is formed through the following process: in the portion irradiated with laser beam 3Y, the electric charge of the surface of the photoreceptor 1Y dissipates due to reduction in the specific resistance of the photosensitive layer, while electric charge remains on the portion that has not been irradiated with laser beam 3Y.

The electrostatic image thus formed on the photoreceptor 1Y is carried to a predetermined development position according to the rotation of the photoreceptor 1Y. At this development position, the electrostatic image on the photoreceptor 1Y is converted to a visual image (developed image) by the developing device 4Y.

For example, a yellow toner having a volume-average particle diameter of 7 μm and containing at least a yellow colorant, a crystalline resin and a noncrystalline resin, is accommodated in the developing device 4Y. The yellow toner is stirred in the inside of the developing device 4Y and thereby is frictionally electrified, so that the yellow toner having the same polarity (negative polarity) as that of electric charge on the photoreceptor 1Y is retained on a developer roll (developer holder). Then, the surface of the photoreceptor 1Y passes through the developing device 4Y during which the yellow toner adheres electrostatically to the electrically neutralized latent image portion on the surface of the photoreceptor 1Y, thus developing the latent image with the yellow toner. The photoreceptor 1Y having the yellow toner image formed thereon is subsequently rotated at a predetermined speed, and the developed toner image on the photoreceptor 1Y is conveyed to a predetermined primary transfer position.

When the yellow toner image on the photoreceptor 1Y is carried to the primary transfer position, a predetermined primary transfer bias is applied to the primary transfer roller 5Y, so that an electrostatic force directed from the photoreceptor 1Y to the primary transfer roller 5Y acts on the toner image. As a result, the toner image on the photoreceptor 1Y is transferred onto the intermediate transfer belt 20. The transfer bias to be applied has (+) polarity, which is opposite to the polarity (−) of the toner. For example, the transfer bias is set to about +10 μA by a control part (not shown), in the case of the first unit 10Y.

On the other hand, the toner remaining on the photoreceptor 1Y is removed and recovered by a cleaning unit 6Y.

The primary transfer bias applied to each of primary transfer rollers 5M, 5C and 5K of the second unit 10M, the third unit 10C, and the fourth unit 10K is controlled in a manner similar to the first unit.

The intermediate transfer belt 20 having the yellow toner image transferred thereon in the first unit 10Y is moved through the second to fourth units 10M, 10C, and 10K in this order, whereby multiple toner images of the respective colors are transferred and stacked.

The intermediate transfer belt 20, on which multiple toner images of the four colors have been transferred through the first to fourth units, reaches a secondary transfer part composed of the intermediate transfer belt 20, the support roller 24 in contact with the inner surface of the intermediate transfer belt 20, and a secondary transfer roller (secondary transfer unit) 26 disposed at the image-holding surface side of the intermediate transfer belt 20. A recording paper (image receiving material) P is supplied by a feeding mechanism at a predetermined timing to the nip portion between the secondary transfer roller 26 and the intermediate transfer belt 20, and a predetermined secondary transfer bias is applied to the support roller 24. The transfer bias to be applied has the same (−) polarity as the polarity (−) of the toner, and electrostatic force directed from the intermediate transfer belt 20 to the recording paper P acts on the toner image. As a result, the toner image on the intermediate transfer belt 20 is transferred onto the recording paper P. The secondary transfer bias is determined depending on the resistance detected by a resistance detector (not shown) for detecting the resistance of the secondary transfer part, and the secondary transfer bias voltage is controlled.

Thereafter, the recording paper P is conveyed to a fixing unit 28 where the toner image is heated, and the toner image of superposed colors is fused and fixed on the recording paper P. After fixation of the color image is finished, the recording paper P is conveyed to a discharging part and a series of these color image forming operations are finished.

Although the image forming apparatus illustrated above is configured to transfer a toner image via the intermediate transfer belt 20 onto the recording paper P, the configuration is not limited to thereto. For example, a configuration may be adopted in which a toner image is transferred from the photoreceptor directly onto the recording paper.

When a toner recycle unit is provided, its system is not particularly limited. The system may be, for example, a method of supplying the toner recovered in the cleaning part to a replenishing toner hopper or the developing device by using a conveyer or a conveyance screw, or a method of mixing the recovered toner with a replenishing toner in an intermediate chamber and supplying the mixture to the developing device. Applicable methods include the method of returning the recovered toner directly to the developing device or the method of mixing the recycle toner with the replenishing toner in the intermediate chamber and supplying the mixture.

Although the charging unit used in the image forming apparatus shown in FIG. 1 is a charging roll, the charging unit is not limited thereto. When corotron is used as a charging unit, ion discharge occurs, and Na ions in the toner are precipitated on the surface. When Na ions are precipitated, hygroscopic property is enhanced, and moisture is easily adsorbed onto the surface of the toner at high temperature and high humidity; therefore, in some cases, developability is lowered, fogging often occurs, and the toner density is reduced.

However, when a charging roll is used as the charging unit, Na ions in the toner are not precipitated on the surface because of less ion discharge; as a result, developability is secured, and a good balance of fogging and density may be realized. Therefore, the use of a charging roll is preferable.

<Process Cartridge, Toner Cartridge>

Figure 2:
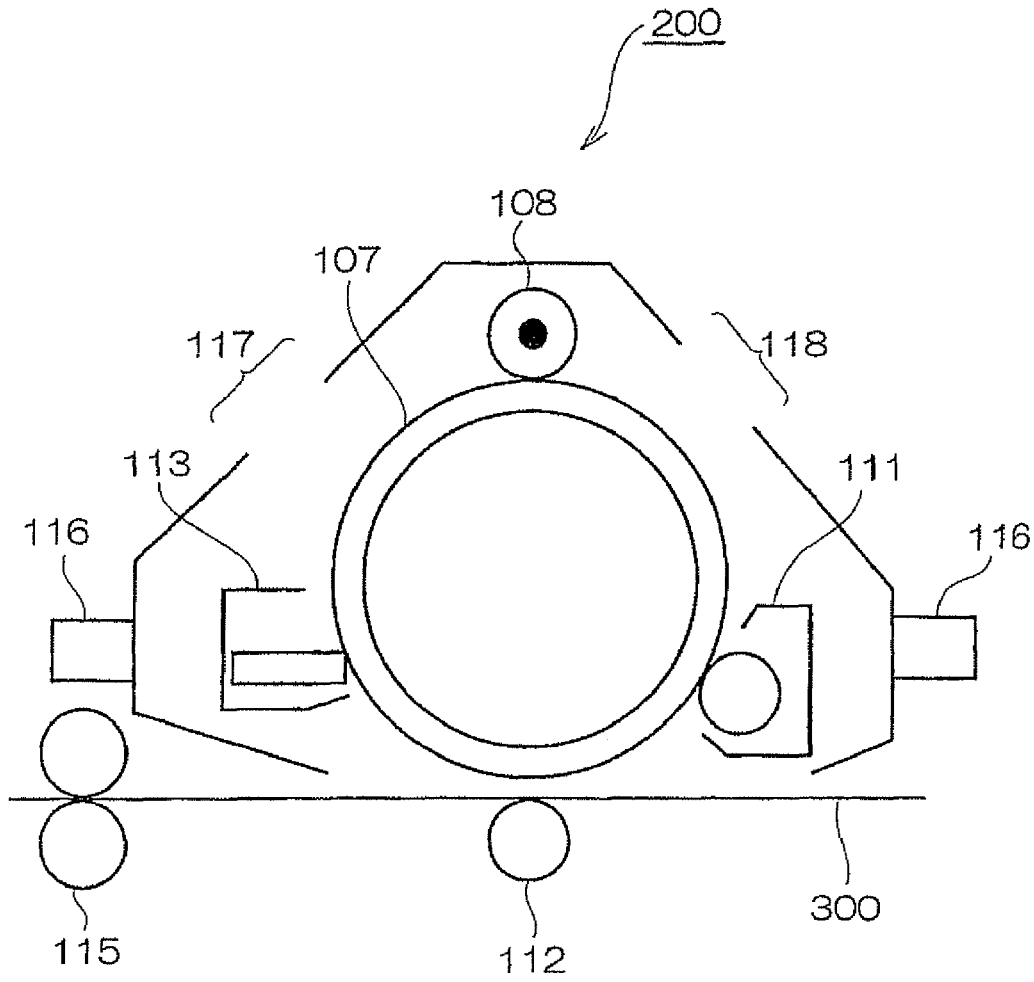
FIG. 2 is a schematic constitutional view showing an example of a process cartridge according to an aspect of the invention.

FIG. 2 is a schematic constitutional view showing one example of the process cartridge that holds the electrostatic image developer according to the invention. The process cartridge 200 includes a photoreceptor 107, a charging, roller 108, a developing device 111, a photoreceptor cleaning unit 113, an opening 118 for light exposure, and an opening 117 for removal of electricity by light exposure, which are combined and integrated by using an attachment rail 116.

The process cartridge 200 is freely attachable to and detachable from the main body of the image forming apparatus including the transfer device 112, the fixing device 115 and other component parts (not shown). A combination of the process cartridge and the main body of the image forming apparatus constitutes the image forming apparatus. The reference character 300 represents a recording paper.

Although the process cartridge shown in FIG. 2 has the charging device 108, the developing device 111, the cleaning device (cleaning unit) 113, the opening 118 for light exposure, and the opening 117 for removal of electricity by light exposure, the process cartridge may include an appropriate combination of such devices. The process cartridge according to the invention has the photoreceptor 107 and at least one member selected from the group consisting of the charging device 108, the developing device 111, the cleaning device (cleaning unit) 113, the opening 118 for light exposure, and the opening 117 for removal of electricity by light exposure.

Next, the toner cartridge according to the invention is described. The toner cartridge according to the invention can be attached to and detached from the image forming apparatus and accommodates at least a toner to be supplied to a developing unit arranged in the image forming apparatus, wherein the toner is the toner according to the invention. The toner cartridge according to the invention accommodates at least the toner, and may further include, for example, a developer depending on the mechanism of the image forming apparatus.

The image forming apparatus shown in FIG. 1 is an image forming apparatus configured to allow attachment and detachment of the toner cartridges 8Y, 8M, 8C and 8K, and the developing units 4Y, 4M, 4C and 4K are connected via toner feeding pipes (not shown) to the toner cartridges corresponding to the respective developing units (colors). When the amount of the toner accommodated in the toner cartridge becomes small, the toner cartridge may be exchanged with another.

EXAMPLES

Hereinafter, the present invention will be described specifically with reference to Examples, which should not be construed as limiting the invention. The "part" and "%" in the Examples below mean respectively "part by weight" and "% by weight", unless otherwise specified.

<Synthesis of Respective Resins>

Synthesis of Crystalline Polyester Resin (a)

1982 parts of sebacic acid, 1490 parts of ethylene glycol, 59.2 parts of sodium dimethyl isophthalate 5-sulfonate and 0.8 part of dibutyltin oxide are reacted at 180° C. for 5 hours in a nitrogen atmosphere in a 5-L flask and then undergo condensation reaction at 220° C. under reduced pressure. During the reaction, the polymer is sampled, and when the molecular weight Mw (weight-average molecular weight) reaches 20000 and Mn (number-average molecular weight)

reaches 8500 according to GPC, the reaction is terminated, to give crystalline polyester resin (a). The melting point (peak temperature in DSC) is 70° C. The content of sodium dimethyl isophthalate 5-sulfonate as determined by NMR is 1 mol % (relative to the whole constituent components).

Synthesis of Crystalline Polyester Resin (b)

1800 parts of sebacic acid, 1073 parts of 1,6-hexanediol, 53.8 parts of sodium dimethyl isophthalate 5-sulfonate and 0.1.13 part of dibutyltin oxide are reacted at 180° C. for 5 hours in a nitrogen atmosphere in a 5-L flask and then undergo condensation reaction at 220° C. under reduced pressure. During the reaction, the polymer is sampled, and when the molecular weight Mw (weight-average molecular weight) reaches 25400 and Mn (number-average molecular weight) reaches 8500 according to GPC, the reaction is terminated, to give crystalline polyester resin (b). The melting point (peak temperature in DSC) is 75° C. The content of sodium dimethyl isophthalate 5-sulfonate as determined by NMR is 1 mol % (relative to the whole constituent components).

Synthesis of Crystalline Polyester Resin (c)

149.7 parts of 1,10-dodecane diacid, 901 parts of 1,4-butanediol, 59.2 parts of sodium dimethyl isophthalate 5-sulfonate and 0.7 part of dibutyltin oxide are reacted at 180° C. for 5 hours in a nitrogen atmosphere in a 5-L flask and then undergo condensation reaction at 220° C. under reduced pressure. During the reaction, the polymer is sampled, and when the molecular weight Mw reaches 9000 and Mn reaches 4500 according to GPC, the reaction is terminated, to give crystalline polyester resin (c). The melting point (peak temperature in DSC) is 80° C. The content of sodium dimethyl isophthalate 5-sulfonate as determined by NMR is 1 mol % (relative to the whole constituent monomers).

Synthesis of Non-crystalline Polyester Resin (1)

A two-necked flask dried by heating is charged with 200 parts of dimethyl terephthalate, 85 parts of 1,3-butanediol and 0.3 part of dibutyltin oxide as a catalyst. The air in the flask is changed to an inactive atmosphere by replacement with nitrogen gas through a depressurization operation, and then the mixture is stirred at 180 rpm for 5 hours by mechanical stirring. Thereafter, the mixture is heated gradually to 230° C. under reduced pressure and stirred for 2 hours. When the mixture becomes viscous, it is cooled by air to terminate the reaction, thereby synthesizing 240 parts of non-crystalline polyester resin (1) (non-crystalline polyester resin containing an acid-derived constituent component and an alcohol-derived constituent component; in the acid-derived constituent component, the content of an aromatic dicarboxylic acid-derived constituent component is 100 constituent %. In the alcohol-derived constituent component, the content of an aliphatic diol-derived constituent component is 100 constituent %).

By measurement of (polystyrene-equivalent) molecular weight by gel permeation chromatography, the weight-average molecular weight (Mw) of the resulting non-crystalline polyester resin (1) is found to be 9500, and the number-average molecular weight (Mn) is found to be 4200. When the DSC spectrum of the non-crystalline polyester resin (1) is measured by the above-mentioned differential scanning calorimeter (USC), no definite peak is observable, and a stepwise change in the endothermic amount is observed. The glass transition point, which is considered to be the midpoint of the stepwise change in the endothermic amount, is 55° C. The resin acid value is 18 mg KOH/g.

<Preparation of Respective Dispersion Liquids>

Crystalline Polyester Resin Dispersion Liquid (a)

160 parts of crystalline polyester resin (a), 233 parts of ethyl acetate, and 0.1 part of (0.3 N) aqueous sodium hydroxide solution are prepared, introduced into a 500-ml separable flask, heated at 70° C. and stirred with a three one motor (manufactured by Shinto Kagaku Co., Ltd.) to prepare a resin mixture liquid. While this resin mixture liquid is further stirred, 373 parts of ion exchange water are gradually added thereto to cause phase-inversion emulsification, and then the temperature of the mixture is decreased to 40° C. at a temperature decrease rate of 10° C./min. The solvent is removed to give a crystalline polyester resin dispersion liquid (solid content: 30%).

Crystalline Polyester Resin Dispersion Liquid (b)

A crystalline polyester resin dispersion liquid (b) (solid content: 30%) is obtained in the same manner as the preparation of the crystalline polyester resin dispersion liquid (a) except that the crystalline polyester resin (b) is used in place of the crystalline polyester resin (a), and that the heating temperature is changed to 75° C.

Crystalline Polyester Resin Dispersion Liquid (c)

A crystalline polyester resin dispersion liquid (c) (solid content: 30%) is obtained in the same manner as the preparation of the crystalline polyester resin dispersion liquid (a) except that a crystalline polyester resin (c) is used in place of the crystalline polyester resin (a), and that the heating temperature is changed to 80° C.

Crystalline Polyester Resin Dispersion Liquid (d)

A crystalline polyester resin dispersion liquid (d) (solid content: 30%) is obtained in the same manner as the preparation of the crystalline polyester resin dispersion liquid (a) except that the temperature decrease rate is changed to 6° C./min.

Crystalline Polyester Resin Dispersion Liquid (e)

A crystalline polyester resin dispersion liquid (e) (solid content: 30%) is obtained in the same manner as the preparation of the crystalline polyester resin dispersion liquid (a) except that the temperature decrease rate is changed to 20° C./min.

Crystalline Polyester Resin Dispersion Liquid (f)

A crystalline polyester resin dispersion liquid (f) (solid content: 30%) is obtained in the same manner as the preparation of the crystalline polyester resin dispersion liquid (a) except that the heating temperature is changed to 65° C.

Crystalline Polyester Resin Dispersion Liquid (g)

A crystalline polyester resin dispersion liquid (g) (solid content: 30%) is obtained in the same manner as the preparation of the crystalline polyester resin dispersion liquid (a) except that the heating temperature is changed to 75° C.

Crystalline Polyester Resin Dispersion Liquid (h)

A crystalline polyester resin dispersion liquid (h) (solid content: 30%) is obtained in the same manner as the preparation of the crystalline polyester resin dispersion liquid (a) except that the temperature decrease rate is changed to 23° C./min.

Crystalline Polyester Resin Dispersion Liquid (i)

A crystalline polyester resin dispersion liquid (i) (solid content: 30%) is obtained in the same manner as the preparation of the crystalline polyester resin dispersion liquid (a) except that the temperature decrease rate is changed to 3° C./min.

Crystalline Polyester Resin Dispersion Liquid (j)

A crystalline polyester resin dispersion liquid (j) (solid content: 30%) is obtained in the same manner as the preparation of the crystalline polyester resin dispersion liquid (a) except that the heating temperature is changed to 60° C.

Crystalline Polyester Resin Dispersion Liquid (k)

A crystalline polyester resin dispersion liquid (k) (solid content: 30%) is obtained in the same manner as the preparation of the crystalline polyester resin dispersion liquid (a)

except that the heating temperature is changed to 80° C. Many coarse particles are observed in the crystalline polyester resin dispersion liquid (k).

Non-Crystalline Polyester Resin Dispersion Liquid 160 parts of non-crystalline polyester resin (1), 233 parts of ethyl acetate, and 0.1 part of (0.3 N) aqueous sodium hydroxide solution are prepared, introduced into a 500-ml separable flask, heated at 70° C. and stirred with a three one motor (manufactured by Shinto Kagaku Co. Ltd.) to prepare a resin mixture. While this resin mixture is further stirred, 373 parts of ion exchange water are gradually added thereto to cause phase inversion emulsification. Then the temperature of the mixture is decreased to 40° C. at a temperature decrease rate of 1° C./min. The solvent is removed, to give a non-crystalline polyester resin dispersion liquid (solid content: 30%).

Release Agent Dispersion Liquid (1)

Hydrocarbon-based Fischer Tropsch wax (FNP0092, melting point 92° C., manufactured by Nippon Seiro Co., Ltd.): 50 parts Anionic surfactant (trade name: NEOGEN RK, manufactured by Dai-ichi Kogyo Seiyaku Co., Ltd.): 0.5 part Ion exchange water: 200 parts The above components are mixed, heated to 95° C., dispersed with a homogenizer (trade name: ULTRA TURRAX T50, manufactured by IKA Co.), and subjected to dispersing treatment with a Manton Golin high pressure homogenizer (Golin Co.) to prepare a release agent dispersion liquid (1) in which the release agent having a volume average particle diameter of 0.23 μm is dispersed (solid content: 20%).

Release Agent Dispersion Liquid (2)

Ester wax (WEP5, melting point 85° C., manufactured by NOF Corporation): 50 parts Anionic surfactant (trade name: NEOGEN RK, manufactured by Dai-ichi Kogyo Seiyaku Co., Ltd.): 0.5 part Ion exchange water, 200 parts The above components are mixed, heated to 95° C., dispersed with a homogenizer (trade name: ULTRA TURRAX T50, manufactured by IKA Co.), and subjected to dispersing treatment with a Manton Golin high pressure homogenizer (Golin Co.) to prepare a release agent dispersion liquid (2) in which the release agent having a volume average particle diameter of 0.23 μm is dispersed (solid content: 20%).

Release Agent Dispersion Liquid (3)

Hydrocarbon-based Fischer Tropsch wax (FT100, melting point 96° C., manufactured by Nippon Seiro Co., Ltd.): 50 parts Anionic surfactant (trade name: NEOGEN RK, manufactured by Dai-ichi Kogyo Seiyaku Co., Ltd.): 0.5 part Ion exchange water: 200 parts The above components are mixed, heated to 95° C., dispersed with a homogenizer (trade name: ULTRA TURRAX T50, manufactured by IKA Co.), and subjected to dispersing treatment with a Manton Golin high pressure homogenizer (Golin Co.) to prepare a release agent dispersion liquid (3) in which the release agent having a volume average particle diameter of 0.23 μm is dispersed (solid content: 20%).

Release Agent Dispersion Liquid (4)

Hydrocarbon-based Fischer Tropsch wax (FNP0085, melting point 84° C., manufactured by Nippon Seiro Co., Ltd.): 50 parts Anionic surfactant (trade name: NEOGEN RK, manufactured by Dai-ichi Kogyo Seiyaku Co., Ltd.): 0.5 part Ion exchange water: 200 parts The above components are mixed, heated to 95° C., dispersed with a homogenizer (trade name: ULTRA TURRAX T50, manufactured by IKA Co.), and subjected to dispersing treatment with a Manton Golin high pressure homogenizer (Golin Co.) to prepare a release agent dispersion liquid (4) in which the release agent having a volume average particle diameter of 0.23 μm is dispersed (solid content: 20%).

Colorant Dispersion Liquid (1)

Black pigment (trade name: Carbon Black #260, primary particle diameter 40 nm, manufactured by Mitsubishi Chemical Corporation): 1000 parts Anionic surfactant (trade name: NEOGEN R, manufactured by Dai-ichi Kogyo Seiyaku Co., Ltd.): 15 parts Ion exchange water: 9000 parts The above components are mixed, dissolved and then dispersed for about 1 hour with a high-pressure impact type dispersing machine Altimizer (trade name: HJP30006, manufactured by Sugino Machine Limited), to prepare a colorant dispersion liquid (1) in which the pigment (colorant) is dispersed. In the resulting colorant dispersion liquid (1), the volume-average particle diameter of the pigment is 0.13 μm, and the solid content is 23%.

Colorant Dispersion Liquid (2)

A colorant dispersion liquid (2) is prepared in the same manner as the preparation of the colorant dispersion liquid (1) except that a black pigment (trade name: Carbon Black #100, primary particle diameter 18 nm, manufactured by Mitsubishi Chemical Corporation) is used in place of Carbon Black #260. In the resulting colorant dispersion liquid, the volume-average particle diameter of the pigment is 0.14 μm, and the solid content is 23%.

Colorant Dispersion Liquid (3)

A colorant dispersion liquid (3) is prepared in the same manner as the preparation of the colorant dispersion liquid (1) except that a black pigment (trade name: Carbon Black #20, primary particle diameter 50 nm, manufactured by Mitsubishi Chemical Corporation) is used in place of Carbon Black #260. In the resulting colorant dispersion liquid (3), the volume-average particle diameter of the black pigment is 0.143 μm, and the solid content is 23%.

Colorant Dispersion Liquid (4)

Cyan pigment (C.I. Pigment Blue 15:3, manufactured by Dainichiseika Color & Chemicals Mfg. Co., Ltd.): 45 parts Ionic surfactant (trade name; NEOGEN RE, manufactured by Dai-ichi Kogyo Seiyaku Co., Ltd.): 5 parts Ion exchange water: 200 parts The above-mentioned ingredients are mixed and dissolved, and then dispersed by a homogenizer (IKA ULTRA TURRAX) for 10 minutes to give a colorant dispersion liquid (4) having a volume-average particle diameter of 170 nm.

Colorant Dispersion Liquid (5)

Magenta pigment (C.I. Pigment Red 238, manufactured by Sanyo Chemical Industries, Ltd.): 45 parts Ionic surfactant (trade name: NEOGEN RK, manufactured by Dai-ichi Kogyo Seiyaku Co., Ltd.): 5 parts Ion exchange water: 200 parts The above-mentioned ingredients are mixed and dissolved, and then dispersed by a homogenizer (IKA ULTRA-TURRAX) for 10 minutes to give a colorant dispersion liquid (5) having a volume-average particle diameter of 155 nm.

Colorant Dispersion Liquid (6)

Magenta pigment (C.I. Pigment Red 192 manufactured by Dainichiseika Color & Chemicals Mfg. Co., Ltd.): 45 parts Ionic surfactant (trade name: NEOGEN (K, manufactured by Dai-ichi Kogyo Seiyaku Co., Ltd.): 5 parts Ion exchange water: 200 parts The above-mentioned ingredients are mixed and dissolved, and then dispersed by a homogenizer (IKA ULTRA-TURRAX) for 10 minutes to give a colorant dispersion liquid (6) having a volume-average particle diameter of 180 nm.

Colorant Dispersion Liquid (7)

Yellow pigment (trade name. Pigment Yellow 74, manufactured by Clariant): 45 parts Ionic surfactant (trade name: NEOGEN RK, manufactured by Dai-ichi Kogyo Seiyaku Co., Ltd.), 5 parts Ion exchange water: 200 parts The above-mentioned ingredients are mixed and dissolved, and then dispersed by a homogenizer (IKA ULTRA-TURRAX) for 10 minutes to give a colorant dispersion liquid (7) having a volume-average particle diameter of 172 mm.

Colorant Dispersion Liquid (8)

A colorant dispersion liquid (8) is prepared in the same manner as the preparation of the colorant dispersion liquid (1) except that a black pigment (trade name: Carbon Black #2700B, primary particle diameter 13 nm, manufactured by Mitsubishi Chemical Corporation) is used in place of Carbon Black #260. In the resulting colorant dispersion liquid (8), the volume-average particle diameter of the black pigment is 0.140 μm, and the solid content is 23%.

<Preparation of Carrier>

Carrier 1

Ferrite particles (volume-average particle diameter: 35 μm, GSDv: 1.20): 100 parts Toluene: 14 parts Perfluoroacrylate copolymer (critical surface tension: 24 dyn/cm): 1.6 parts Carbon black (trade name: VXC-72, volume resistivity: 100 Ωcm or less, manufactured by Cabot Corporation): 0.12 part Crosslinked melamine resin particles (average particle diameter: 0.3 μm, insoluble in toluene): 0.3 part First, carbon black is diluted with toluene and added to the perfluoroacrylate copolymer and then dispersed with a sand mill. Then, the above components except for ferrite particles are dispersed for 10 minutes with a stirrer to prepare a coating layer forming solution. Then, this coating layer forming solution and the ferrite particles are introduced into a vacuum degassing kneader and stirred at a temperature of 60° C. for 30 minutes. Then the reaction system is depressurized to distil away the toluene, whereby a carrier 1 having a resin coating layer formed thereon is obtained.

Example 1

Production of Toner (1)

Crystalline polyester resin dispersion liquid (a): 17 parts

Non-crystalline polyester resin dispersion liquid (1): 190 parts

Colorant dispersion liquid (1): 34 parts

Release agent dispersion liquid (1): 50 parts

Anionic surfactant (trade name: DOWFAX 2A1, 20% aqueous solution, manufactured by Dow Chemical): 10 parts The above raw materials are introduced into a 2-L cylindrical stainless steel container and dispersed and mixed for 10 minutes under a shear strength at 4000 rpm by a homogenizer (trade name: ULTRA-TURRAX T50, manufactured by IKA). Then, 1.75 parts of 10% aqueous nitric acid solution of polyaluminum chloride as an aggregating agent is added dropwise, and the mixture is dispersed and mixed for 15 minutes at 5000 rpm with the homogenizer to prepare a dispersion liquid of the raw materials.

Thereafter, the raw material dispersion liquid is transferred to a polymerization kettle equipped with a stirring instrument and a thermometer, and then heated with a mantle heater to promote growth of aggregated particles at 42° C. At this time, the pH of the raw material dispersion liquid is regulated within the range of from 2.2 to 3.5 with 0.3 M nitric acid and/or 1 N aqueous sodium hydroxide solution. The dispersion liquid is maintained for about 2 hours within the above pH range to form aggregated particles. The volume-average particle diameter of the aggregated particles as determined by Multisizer II (aperture diameter: 50 μm, manufactured by Beckman Coulter, Inc.) is 5.4 μm.

Then, 70 parts of the non-crystalline polyester resin dispersion liquid is further added, and the resin particles of the non-crystalline polyester resin (1) adhere to the surfaces of the aggregated particles. The dispersion liquid is heated to 44° C. and the aggregated particles are controlled while confirming the size and shape of the particles with an optical microscope and Multisizer II. Thereafter, the pH of the dispersion liquid is increased to pH 8.0 and then the dispersion liquid is heated to 70° C. to fuse the aggregated particles. After it is confirmed under an optical microscope that the aggregated particles are not fused, a mixture of 10 parts of 0.3 M nitric acid and 4 parts of 20% Dowfax 2A1 is added thereto. After the mixture is kept at 70° C. for 2 hours, it is confirmed under an optical microscope that the aggregated particles are fused, followed by cooling at a temperature decrease rate of 20° C./min. Thereafter, the aggregated particles are sifted through a 20-μm mesh and then repeatedly washed with water and dried with a vacuum dryer to give toner mother particles (1).

Silica particles having a primary particle diameter of 40 nm having a hydrophobized surface (hydrophobic silica RX 50, manufactured by Aerosil Co.) as an external additive, and metatitanic acid compound particles having a primary particle average diameter of 20 nm, are added to 100 parts of the toner mother particles such that their contents in the toner are 1.0% each, wherein the metatitanic acid compound particles are a reaction product obtained by treating 100 parts of metatitanic acid with 40 parts of isobutyltrimethoxysilane and 10 parts of trifluoropropyltrimethoxysilane. The obtained mixture is stirred for 5 minutes in a Henschel mixer. Further, the product is further subjected to an ultrasonic vibrating sieve (manufactured by Dalton) to give a toner (1).

The volume-average particle diameter of the resulting toner (1) is 6.1 μm, the GSDv is 1.20, and GSDp is 1.25. In observation of a section of the toner (1) with TEM, it is confirmed that the dispersion state of the colorant in the toner is excellent. In observation of a section of the toner with staining SEM, it is confirmed that the dispersion state of the crystalline polyester resin in the toner is excellent. With respect to voids in the toner in observation of a section of the toner with SEM, it is confirmed that there are few voids. 6 g of the toner is compression-molded into a disk of 50 mm in diameter and 3 mm in thickness by application of 98067 kPa (1000 kgf/cm$^2$) for 2 minutes, and then left for 24 hours in an atmosphere of 30° C. and 90% humidity. Then, the toner in the disk shape is set on an electrode for solid having an electrode diameter of 38 mm (SE-71, manufactured by Ando Electric Co., Ltd.) and measured for its dielectric loss index ∈" under the conditions of 500 V and 0.1 Hz with a dielectric measurement system 126096W manufactured by Solartron Ltd.; as a result, the dielectric loss index ∈" is found to be 0.015. When the dielectric loss index ∈" is similarly measured at 1000 Hz and 3 V, the dielectric loss index ∈" is 0.018. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Preparation of Developer 36 parts of the resulting toner (1) and 414 parts of the carrier 1 are introduced into a 2-L V-blender, stirred for 20 minutes and sifted with a 212-μm mesh to prepare a developer (1).

Evaluation of Toner

—Evaluation of Fogging—

The resulting developer (1) is set in a developing apparatus of a modified version of DocuCentre Color 400CP manufactured by Fuji Xerox Co., Ltd., (equipped with an image holding member, a charging unit, a light exposure unit, a developing unit, a transfer unit and a fixation unit; the charging unit is a unit using a charging roller that charges the photoreceptor by discharge in the vicinity of an area of contact with the photoreceptor, wherein the discharge is generated by application of voltage to a semi-conductive rubber roller), and is used in a test of forming images successively on 5000 sheets in an environmental chamber at room temperature (32° C.) under 75% humidity. The matter remaining on the photoreceptor is transferred by using a tape, and its optical density is measured with a densitometer X-Rite 404A manufactured by X-Rite. The evaluation value is D=(measurement density)−(density of the tape alone). The results are shown in Table 1.

The D value is desirably 0.05 or less.

—Evaluation of Image Density—

Using the apparatus used in the evaluation of fogging, solid images of 40 mm×50 mm with an initial amount of 0.50 mg toner/cm on recording paper J (manufactured by Fuji Xerox Co., Ltd.) are formed successively on 5000 sheets. The fixing temperature is 160° C. The 5000th sheet is measured for brightness L* at five positions with a densitometer X-Rite 404A manufactured by X-Rite, and the average of the measured values at the five positions is indicated as brightness L*. The results are shown in Table 1.

The brightness L* is desirably less than 15 (excluding Examples 19 to 21, Comparative Examples 11 to 13).

—Evaluation of Low-Temperature Fixability—

The resulting developer (1) is charged into a developing apparatus (developing unit) of DocuCentre Color 500 from which a fixation device has been detached. The DocuCentre Color 500 is originally equipped with an image holding member, a charging unit, a light exposure unit, a developing unit, a transfer unit and a fixation unit. The charging unit is a unit using a charging roller that charges the photoreceptor by discharge in the vicinity of an area of contact with the photoreceptor, wherein the discharge is generated by application of voltage to a semi-conductive rubber roller. An unfixed 40 mm×50 mm solid image having 0.50 mg toner/cm$^2$ is formed on mirror coat platinum paper (basis weight: 127 gsm) as a recording paper.

Then, a developing device of DocuCentre Color 500 (manufactured by Fuji Xerox Co., Ltd.) is modified such that the fixing temperature is made variable. The fixability of the image is evaluated at stepwise increased fixing temperatures from 90° C. to 140° C. In the evaluation of fixability, the fixed image is bent for 10 seconds under a load (60 sN/m$^2$) and then returned to the unbent state. The lowest fixing temperature at which the maximum width of the image defect portion in the bent portion is 0.3 mm or less is regarded as the minimum fixation temperature. The results are shown in Table 1.

The minimum fixation temperature is desirably less than 125° C.

Example 2

A toner (2) is prepared in the same manner as in production of the toner in Example 1 except that the crystalline polyester resin dispersion liquid (b) is used in place of the crystalline polyester resin dispersion liquid (a), and the fusion temperature is 65° C. instead of 70° C. The resulting toner (2) has a volume-average particle diameter of 6.2 μm, a GSDv of 1.20 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is excellent. In observation of the toner section with SEM, it can also be confirmed that the toner has few voids. Dielectric loss index ∈" under the conditions of 500 V and 0.1 HHz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 3

A toner (3) is prepared in the same manner as in production of the toner in Example 1 except that the crystalline polyester resin dispersion liquid (c) is used in place of the crystalline polyester resin dispersion liquid (a), and the fusion temperature is 75° C. instead of 70° C. The resulting toner (3) has a volume-average particle diameter of 6.0 μm, a GSDv of 1.20 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is excellent. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., t the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 4

A toner (4) is prepared in the same manner as in production of the toner in Example 1 except that the fusion temperature is 75° C. instead of 70° C. The resulting toner (4) has a volume-average particle diameter of 5.9 μm, a GSDv of 1.20 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is excellent. In observation of the toner section with SEM, it can also be confirmed that, though voids are observable, the toner has only a few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 5

A toner (5) is prepared in the same manner as in production of the toner in Example 1 except that the fusion temperature is 65° C. instead of 70° C. The resulting toner (5) has a volume-average particle diameter of 6.0 μm, a GSDv of 1.20 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is excellent. In observation of the toner section with SEM, it can also be confirmed that, though voids are observable, the toner has only a few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 6

A toner (6) is prepared in the same manner as in production of the toner in Example 1 except that a mixture of 10 parts of 0.3 M nitric acid and 0.5 g, of 20% DOWFAX 2A1 is added in place of the mixture of 10 parts of 0.3 M nitric acid and 4 parts of 20% DOWFAX 2A1. The resulting toner (6) has a volume-average particle diameter of 6.5 μm, a GSDv of 1.22 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is excellent. In observation of the toner section with SEM, it can also be confirmed that, though voids are observable, the toner has only a few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 7

A toner (7) is prepared in the same manner as in production of the toner in Example 1 except that a mixture of 10 parts of 0.3 M nitric acid and 7.5 parts of 20% DOWFAX 2A1 is added in place of the mixture of 10 parts of 0.3 M nitric acid and 4 parts of 20% DOWFAX 2A1. The resulting toner (7) has a volume-average particle diameter of 5.8 μm, a GSDv of 1.20 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is excellent. In observation of the toner section with SEM, it can also be confirmed that, though voids are observable, the toner has only a few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 8

A toner (8) is prepared in the same manner as in production of the toner in Example 1 except that the crystalline polyester resin dispersion liquid (d) is used in place of the crystalline polyester resin dispersion liquid (a). The resulting toner (8) has a volume-average particle diameter of 6.0 μm, a GSDv of 1.20 and a GSDp of 1.24, and in the observation of a section of the toner with TEM, the dispersion state of the colorant in the toner is excellent. In observation of a section of the toner with staining SEM, it is confirmed that the dispersion state of the crystalline polyester resin in the toner is basically satisfactory although the slight unevenness in the distribution of the crystalline polyester resin is observed. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 9

A toner (9) is prepared in the same manner as in production of the toner in Example 1 except that the crystalline polyester resin dispersion liquid (e) is used in place of the crystalline polyester resin dispersion liquid (a). The resulting toner (9) has a volume-average particle diameter of 5.7 μm, a GSDv of 1.20 and a GSDp of 1.26, and in the observation of a section of the toner with TEM, the dispersion state of the colorant in the toner is excellent. In observation of a section of the toner with staining SEM, it is confirmed that the dispersion state of the crystalline polyester resin in the toner is basically satisfactory although slight unevenness in the distribution of the crystalline polyester resin is observable. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 10

A toner (10) is prepared in the same manner as in production of the toner in Example 1 except that the crystalline polyester resin dispersion liquid (f) is used in place of the crystalline polyester resin dispersion liquid (a). The resulting toner (10) has a volume-average particle diameter of 6.1 μm, a GSDv of 1.20 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is basically satisfactory although slight unevenness in the distribution of the crystalline polyester resin is observable. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 11

A toner (11) is prepared in the same manner as in production of the toner in Example 1 except that the crystalline polyester resin dispersion liquid (g) is used in place of the crystalline polyester resin dispersion liquid (a). The resulting toner (11) has a volume-average particle diameter of 6.2 μm, a GSDv of 1.20 and a GSDp of 1.23, and in the observation of a section of the toner with TEM, the dispersion state of the colorant in the toner is excellent. In observation of a section of the toner with staining SEM, it is confirmed that the dispersion state of the crystalline polyester resin in the toner is basically satisfactory although slight unevenness in the distribution of the crystalline polyester resin is observable. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, the viscosity at 140° C., as determined with an E type viscometer equipped with a cone plate with a cone angle of 1.34 degrees, is 3.1 mPa·s.

Example 12

A toner (12) is prepared in the same manner as in production of the toner in Example 1 except that 0.3 M nitric acid used in the fusion step is replaced by 0.3 M phosphoric acid. The resulting toner (12) has a volume-average particle diameter of 6.0 μm, a GSDv of 1.20 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is basically satisfactory. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 decrees, is 3.1 mPa·s.

Example 13

A toner (13) is prepared in the same manner as in production of the toner in Example 1 except that 20% Dowfax 2A1 used in the fusion step is replaced by an ionic surfactant, NEOGEN RK (Dai-ichi Kogyo Seiyaku Co., Ltd.). The resulting toner (13) has a volume-average particle diameter of 6.3 μm, a GSDv of 1.20 and a GSDp of 1.24, and in the observation of a section of the toner with TEM, the dispersion state of the colorant in the toner is excellent. In observation of a section of the toner with staining SEM, it is confirmed that the dispersion state of the crystalline polyester resin in the toner is basically satisfactory. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 14

A toner (14) is prepared in the same manner as in production of the toner in Example 1 except that 65 parts of the crystalline polyester resin dispersion liquid (a) are used in place of 17 parts of the crystalline polyester resin dispersion liquid (a). The resulting toner (14) has a volume-average particle diameter of 5.8 μm, a GSDv of 1.20 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is basically satisfactory although slight unevenness in the distribution of the crystalline polyester resin is observable. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 15

A toner (15) is prepared in the same manner as in production of the toner in Example 1 except that 3.4 parts of the crystalline polyester resin dispersion liquid (a) are used in place of 17 parts of the crystalline polyester resin dispersion liquid (a). The resulting toner (15) has a volume-average particle diameter of 6.0 μm, a GSDv of 1.20 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is basically satisfactory although slight unevenness in the distribution of the crystalline polyester resin is observable. In observation of the toner section with SEM, it can also be confirmed that the toner has few voids. Dielectric loss index ∈" under the conditions of 500 V and 0.1 Hz and dielectric loss index ∈"; under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 16

A toner (16) is prepared in the same manner as in production of the toner in Example 1 except that the colorant dispersion liquid (8) is used in place of the colorant dispersion liquid (1). The resulting toner (16) has a volume-average particle diameter of 5.9 μm, a GSDv of 1.20 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is basically satisfactory although slight unevenness in the distribution of the crystalline polyester resin is observable. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 17

A toner (17) is prepared in the same manner as in production of the toner in Example 1 except that the colorant dispersion liquid (2) is used in place of the colorant dispersion liquid (1). The resulting toner (17) has a volume-average particle diameter of 5.7 μm, a GSDv of 1.20 and a GSDp of 1.22, and in the observation of a section of the toner with TEM, the dispersion state of the colorant in the toner is excellent. In observation of a section of the toner with staining SEM, it is confirmed that the dispersion state of the crystalline polyester resin in the toner is basically satisfactory although slight unevenness in the distribution of the crystalline polyester resin is observable. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 18

A toner (18) is prepared in the same manner as in production of the toner in Example 1 except that the colorant dispersion liquid (3) is used in place of the colorant dispersion liquid (1). The resulting toner (18) has a volume-average particle diameter of 6.1 μm, a GSDv of 1.20 and a GSDp of 1.21, and in the observation of a section of the toner with TEM, the dispersion state of the colorant in the toner is satisfactory although slight unevenness in the distribution of the colorant is observable. In observation of a section of the toner with staining SEM, it is confirmed that the dispersion state of the crystalline polyester resin in the toner is excellent. In observation of the toner section with SEM, it can also be confirmed that the toner has few voids. Dielectric loss index ∈" under the conditions of 500 V and 0.1 HHz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Example 19

A toner (18) is prepared in the same manner as in production of the toner in Example 1 except that the colorant dispersion liquid (4) is used in place of the colorant dispersion liquid (1). The resulting toner (19) has a volume-average particle diameter of 6.0 μm, a GSDv of 1.25 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is excellent. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

The toner in Example 19 is a cyan toner which, unlike a black toner, is required to exhibit broad color reproducibility and higher L*. Accordingly, the criterion for the judgment of L* for the cyan toner is, (i) an L* of 50 or more is satisfactory, and (ii) an L* of less than 50 is unsatisfactory.

Example 20

A toner (20) is prepared in the same manner as in production of the toner in Example 19 except that 8.5 parts of the colorant dispersion liquid (5) and 8.5 parts of the colorant dispersion liquid (6) are used in place of the colorant dispersion liquid (4). The resulting toner (20) has a volume-average particle diameter of 6.2 μm, a GSDv of 1.25 and a GSDp of 1.24, and in the observation of a section of the toner with TEM, the dispersion state of the colorant in the toner is excellent. In observation of a section of the toner with staining SEM, it is confirmed that the dispersion state of the crystalline polyester resin in the toner is excellent. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

The toner in Example 20 is a magenta toner which, unlike a black toner, is required to exhibit broad color reproducibility and higher L*. Accordingly, the criterion for the judgment of L* for the magenta toner is, (i) an L* of 44 or more is satisfactory, and (ii) an L* of less than 44 is unsatisfactory.

Example 21

A toner (21) is prepared in the same manner as in production of the toner in Example 19 except that the colorant dispersion liquid (7) is used in place of the colorant dispersion liquid (4). The resulting toner (21) has a volume-average particle diameter of 6.0 μm, a GSDv of 1.25 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is excellent. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peal, of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

The toner in Example 21 is a yellow toner which, unlike a black toner, is required to exhibit broad color reproducibility and higher L*. Accordingly, the criterion for the judgment of L* for the yellow toner is, (i) an L* of 90 or more is satisfactory, and (ii) an L* of less than 90 is unsatisfactory.

Example 22

A toner (22) is prepared in the same manner as in production of the toner in Example 19 except that the release agent dispersion liquid (2) is used in place of the release agent dispersion liquid (1). The resulting toner (22) has a volume-average particle diameter of 6.3 μm, a GSDv of 1.25 and a GSDp of 1.26, and in the observation of a section of the toner with TEM, the dispersion state of the colorant in the toner is excellent. In observation of a section of the toner with staining SEM, it is confirmed that the dispersion state of the crystalline polyester resin in the toner is excellent. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 85° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 2.0 mPa·s.

Example 23

A toner (23) is prepared in the same manner as in production of the toner in Example 19 except that 25 parts of the release agent dispersion liquid (3) are used in place of 50 parts of the release agent dispersion liquid (1). The resulting toner (23) has a volume-average particle diameter of 6.0 μm, a GSDv of 1.25 and a GSDp of 1.25, and in the observation of a section of the toner with TEM, the dispersion state of the colorant in the toner is excellent. In observation of a section of the toner with staining SEM, it is confirmed that the dispersion state of the crystalline polyester resin in the toner is excellent. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 96° C., the proportion of the area defined by the endothermic profile at 85° C. or less to area defined by the entire endothermic profile is 4%, and the content of the release agent in the toner, as determined from the height of the endothermic peak, is 5%, and the viscosity at 140° C., as determined with an E type viscometer equipped with a cone plate with a cone angle of 1.34 degrees, is 6 mPa·s.

Example 24

A toner (24) is prepared in the same manner as in production of the toner in Example 19 except that 80 parts of the release agent dispersion liquid (4) are used in place of 50 parts of the release agent dispersion liquid (1). The resulting toner (24) has a volume-average particle diameter of 6.1 μm a GSDv of 1.25 and a GSDp of 1.27, and in the observation of a section of the toner with TEM, the dispersion state of the colorant in the toner is excellent. In observation of a section of the toner with staining SEM, it is confirmed that the dispersion state of the crystalline polyester resin in the toner is excellent. In observation of the toner section with SEM, it can also be confirmed that the toner has few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 84° C., the proportion of the area defined by the endothermic profile at 85° C. or less to area defined by the entire endothermic profile is 17%, and the content of the release agent in the toner, as determined from the height of the endothermic peak, is 16%, and the viscosity at 140° C., as determined with an E type viscometer equipped with a cone plate with a cone angle of 1.34 degrees, is 1.3 mPa·s.

Developers are prepared from the resulting toners (2) to (24) in the same manner as in Example 1 to evaluate the toners. The results together with the characteristics of the toners are shown in Table 1.

Comparative Example 1

A toner (25) is prepared in the same manner as in production of the toner in Example 1 except that the fusion temperature is changed from 70° C. to 78° C. The resulting toner (25) has a volume-average particle diameter of 6.0 μm, a GSDv of 1.20 and a GSDp of 1.25, and in observation of a section of the toner with TEM, it is confirmed that, though slight unevenness in the distribution of the colorant in the toner is observable, the dispersion state of the colorant is basically satisfactory. In observation of a section of the toner with staining SEM, it is confirmed that the dispersion state of the crystalline polyester resin in the toner is basically satisfactory although slight unevenness in the distribution of the crystalline polyester resin is observable. In observation of the toner section with SEM, it can also be confirmed that the toner has a large number of voids. Dielectric loss index ∈" under the conditions of 500 V and 0.1 HHz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 decrees, is 3.1 mPa·s.

Comparative Example 2

A toner (26) is prepared in the same manner as in production of the toner in Example 1 except that the fusion temperature is changed from 70° C. to 63° C. The resulting toner (26) has a volume-average particle diameter of 6.2 μm, a GSDv of 1.20 and a GSDp of 1.25, and in observation of a section of the toner with TEM, it is confirmed that, though slight unevenness in the distribution of the colorant in the toner is observable, the dispersion state of the colorant is basically satisfactory. In observation of a section of the toner with staining SEM, it is confirmed that the dispersion state of the crystalline polyester resin in the toner is basically satisfactory although slight unevenness in the distribution of the crystalline polyester resin is observable. In observation of the toner section with SEM, it can also be confirmed that the toner has a large number of voids. Dielectric loss index ∈" under the conditions of 500 V and 0.1 HHz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Comparative Example 3

A toner (27) is prepared in the same manner as in production of the toner in Example 1 except that a mixture of 10 parts of 0.3 M nitric acid and 8 parts of 20% DOWFAX 2A1 is added in place of the mixture of 10 parts of 0.3 M nitric acid and 4 parts of 20% DOWFAX 2A1. The resulting toner (27) has a volume-average particle diameter of 5.8 μm, a GSDv of 1.20 and a GSDp of 1.25, and in the observation of a section of the toner with TEM, the dispersion state of the colorant is basically satisfactory although slight unevenness in the distribution of the colorant is observable. In observation of a section of the toner with staining SEM, it is confirmed that the dispersion state of the crystalline polyester resin in the toner is basically satisfactory although slight unevenness in the distribution of the crystalline polyester resin is observable. In observation of the toner section with SEM, it can also be confirmed that the toner has a large number of voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Comparative Example 4

A toner (28) is prepared in the same manner as in production of the toner in Example 1 except that 10 g of 0.3 M nitric acid is added in place of the mixture of 10 parts of 0.3 M nitric acid and 4 parts of 20% DOWFAX 2A1. The resulting toner (28) has a volume-average particle diameter of 10.5 μm, a GSDv of 1.38 and a GSDp of 1.25, and in the observation of a section of the toner with TEM, the dispersion state of the colorant is basically satisfactory although slight unevenness in the distribution of the colorant is observable. In observation of a section of the toner with staining SEM, it is confirmed that the dispersion state of the crystalline polyester resin in the toner is basically satisfactory although the crystalline polyester resin is slightly unevenly distributed. In observation of the toner section with SEM, it can also be confirmed that the toner has a large number of voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Comparative Example 5

A toner (29) is prepared in the same manner as in production of the toner in Example 1 except that the crystalline polyester resin dispersion liquid (h) is used in place of the crystalline polyester resin dispersion liquid (a). The resulting toner (29) has a volume-average particle diameter of 5.9 μm, a GSDv of 1.20 and a GSDp of 1.25, and in observation of a section of the toner with TEM, it is confirmed that the colorant in the toner is unevenly distributed. In observation of a section of the toner with staining SEM, it is confirmed that the crystalline polyester resin in the toner is unevenly distributed. In observation of the toner section with SEM, it can also be confirmed that, though voids are observable, the toner has only a few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C. the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Comparative Example 6

A toner (30) is prepared in the same manner as in production of the toner in Example 1 except that the crystalline polyester resin dispersion liquid (i) is used in place of the crystalline polyester resin dispersion liquid (a). The resulting toner (30) has a volume-average particle diameter of 6.0 μm, a GSDv of 1.20 and a GSDp of 1.26, and in observation of a section of the toner with TEM, it is confirmed that the colorant in the toner is unevenly distributed. In observation of a section of the toner with staining SEM, it is confirmed that the crystalline polyester resin in the toner is unevenly distributed. In observation of the toner section with SEM, it can also be confirmed that, though voids are observable, the toner has only a few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Comparative Example 7

A toner (31) is prepared in the same manner as in production of the toner in Example 1 except that the crystalline polyester resin dispersion liquid (j) is used in place of the crystalline polyester resin dispersion liquid (a). The resulting toner (31) has a volume-average particle diameter of 5.8 μm, a GSDv of 1.20 and a GSDp of 1.25, and in observation of a section of the toner with TEM, it is confirmed that the colorant in the toner is unevenly distributed. In observation of a section of the toner with staining SEM, it is confirmed that the crystalline polyester resin in the toner is unevenly distributed. In observation of the toner section with SEM, it can also be confirmed that, though voids are observable, the toner has only a few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Comparative Example 8

A toner (32) is prepared in the same manner as in production of the toner in Example 1 except that the crystalline polyester resin dispersion liquid (k) is used in place of the crystalline polyester resin dispersion liquid (a). The resulting toner (32) has a volume-average particle diameter of 6.0 μm, a GSDv of 1.20 and a GSDp of 1.24, and in observation of a section of the toner with TEM, it is confirmed that the colorant in the toner is unevenly distributed. In observation of a section of the toner with staining SEM, it is confirmed that the crystalline polyester resin in the toner is unevenly distributed. In observation of the toner section with SEM, it can also be confirmed that, though voids are observable, the toner has only a few voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Comparative Example 9

A toner (33) is prepared in the same manner as in production of the toner in Example 1 except that 1.7 parts of the crystalline polyester resin dispersion liquid (a) are used in place of 17 parts of the crystalline polyester resin dispersion liquid (a). The resulting toner (33) has a volume-average particle diameter of 5.9 μm, a GSDv of 1.20 and a GSDp of 1.28, and in observation of a section of the toner with TEM, it is confirmed that the dispersion of the colorant in the toner is basically excellent although the colorant is slightly unevenly distributed. In observation of a section of the toner with staining SEM, it is confirmed that the dispersion state of the crystalline polyester resin in the toner is basically satisfactory although slight unevenness in the distribution of the crystalline polyester resin is observable. In observation of the toner section with SEM, it can also be confirmed that the toner has a large number of voids. Dielectric loss index ∈" under the conditions of 500 V and 0.1 HHz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

Comparative Example 10

A toner (34) is prepared in the same manner as in production of the toner in Example 1 except that 69.7 parts of the crystalline polyester resin dispersion liquid (a) are used in place of 17 parts of the crystalline polyester resin dispersion liquid (a). The resulting toner (34) has a volume-average particle diameter of 6.1 μm, a GSDv of 1.20 and a GSDp of 1.25, and in observation of a section of the toner with TEM, it is confirmed that the dispersion of the colorant in the toner is basically excellent although the colorant is slightly unevenly distributed. In observation of a section of the toner with staining SEM, it is confirmed that the dispersion state of the crystalline polyester resin in the toner is basically satisfactory although slight unevenness in the distribution of the crystalline polyester resin is observable. In observation of the toner section with SEM, it can also be confirmed that the toner has a large number of voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 decrees, is 3.1 mPa·s.

Comparative Example 11

A toner (35) is prepared in the same manner as in production of the toner in Comparative Example 1 except that the colorant dispersion liquid (4) is used in place of the colorant dispersion liquid (1). The resulting toner (35) has a volume-average particle diameter of 6.0 μm, a GSDv of 1.25 and a GSDp of 1.25, and in observation of a section of the toner with TEM, it is confirmed that the dispersion state of the pigment in the toner is excellent. In observation of a section of the toner with staining SEM, the dispersion state of the crystalline polyester resin in the toner is excellent. In observation of the toner section with SEM, it can also be confirmed that the toner has a large number of voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

The toner in Comparative Example 11 is a cyan toner which, unlike a black toner, is required to exhibit broad color reproducibility and higher L*. Accordingly, the criterion for the judgment of L* for the cyan toner is, (i) an L* of 50 or more is satisfactory, and (ii) an L* of less than 50 is unsatisfactory.

Comparative Example 11

A toner (36) is prepared in the same manner as in production of the toner in Comparative Example 11 except that 8.5 parts of the colorant dispersion liquid (5) and 8.5 parts of the colorant dispersion liquid (6) are used in place of the colorant dispersion liquid (4). The resulting toner (36) has a volume-average particle diameter of 6.2 μm, a GSDv of 1.25 and a GSDp of 1.24, and in the observation of a section of the toner with TEM, the dispersion state of the pigment in the toner is excellent. In observation of a section of the toner with staining SEM, it is confirmed that the dispersion state of the crystalline polyester resin in the toner is excellent. In observation of the toner section with SEM, it can also be confirmed that the toner has a large number of voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an B type viscometer equipped with a cone plate with a cone angle of 1.34 degrees, is 3.1 mPa·s.

The toner in Comparative Example 12 is a magenta toner which, unlike a black toner, is required to exhibit broad color reproducibility and higher L*. Accordingly, the criterion for the judgment of L* for the magenta toner is (i) an L* of 44 or more is satisfactory, and (ii) an L* of less than 44 is unsatisfactory.

Comparative Example 13

A toner (37) is prepared in the same manner as in production of the toner in Comparative Example 11 except that the colorant dispersion liquid (7) is used in place of the colorant dispersion liquid (4). The resulting toner (37) has a volume-average particle diameter of 6.0 μm, a GSDv of 1.25 and a GSDp of 1.25, and in the observation of a section of the toner with TEM, the dispersion state of the pigment in the toner is excellent. In observation of a section of the toner with staining SEM, it is confirmed that the dispersion state of the crystalline polyester resin in the toner is excellent. In observation of the toner section with SEM, it can also be confirmed that the toner has a large number of voids. Dielectric loss index ∈" under the conditions of 500 V and 0.1 Hz and dielectric loss index ∈" under the conditions of 1000 Hz and 3 V are measured in the same manner as in Example 1. The results are shown in Table 1. The peak of the endothermic profile is at 91° C., the proportion of the area defined by the endothermic profile at 85° C. or less to area defined by the entire endothermic profile is 9%, and the content of the release agent in the toner, as determined from the height of the endothermic peak, is 10%, and the viscosity at 140° C., as determined with an E type viscometer equipped with a cone plate with a cone angle of 1.34 degrees, is 3.1 mPa·s.

The toner in Comparative Example 13 is a yellow toner which, unlike a black toner, is required to exhibit broad color reproducibility and higher L*. Accordingly, the criterion for the judgment of L* for the yellow toner is (i) an L* of 90 or more is satisfactory, and (ii) an L* of less than 90 is unsatisfactory.

Developers are prepared from the resulting toners (25) to (37) in the same manner as in Example 1 to evaluate the toners. The results together with the characteristics of the toners are shown in Table 1.

TABLE 1

| | Dielectric Loss Index ∈" | | Evaluation Results | | |
|---|---|---|---|---|---|
| | 0.1 Hz, 500 V | 1000 Hz, 3 V | Evaluation on Fogging | Evaluation on Image Density | Evaluation on Low-temperature Fixability |
| Example 1 | 0.015 | 0.018 | 0.01 | 13.0 | 120 |
| Example 2 | 0.02 | 0.02 | 0.01 | 13.5 | 120 |
| Example 3 | 0.02 | 0.019 | 0.01 | 13.2 | 120 |
| Example 4 | 0.04 | 0.024 | 0.03 | 13.5 | 120 |
| Example 5 | 0.05 | 0.023 | 0.04 | 13.1 | 120 |
| Example 6 | 0.06 | 0.023 | 0.03 | 12.9 | 120 |
| Example 7 | 0.05 | 0.028 | 0.03 | 13.0 | 120 |
| Example 8 | 0.06 | 0.03 | 0.02 | 14.5 | 120 |
| Example 9 | 0.05 | 0.029 | 0.02 | 14.3 | 120 |
| Example 10 | 0.07 | 0.28 | 0.01 | 14.2 | 120 |
| Example 11 | 0.06 | 0.029 | 0.02 | 14.8 | 120 |
| Example 12 | 0.02 | 0.02 | 0.02 | 13.2 | 120 |
| Example 13 | 0.02 | 0.019 | 0.03 | 13.3 | 120 |
| Example 14 | 0.05 | 0.028 | 0.05 | 14.8 | 120 |
| Example 15 | 0.06 | 0.018 | 0.04 | 14.6 | 124 |
| Example 16 | 0.05 | 0.032 | 0.05 | 14.5 | 120 |
| Example 17 | 0.04 | 0.01 | 0.02 | 14.9 | 120 |
| Example 18 | 0.08 | 0.028 | 0.05 | 12.5 | 120 |
| Example 19 | 0.015 | 0.018 | 0.01 | 51.0 | 120 |
| Example 20 | 0.02 | 0.018 | 0.02 | 45.0 | 120 |
| Example 21 | 0.02 | 0.02 | 0.02 | 91.0 | 120 |
| Example 22 | 0.04 | 0.029 | 0.05 | 14.9 | 120 |
| Example 23 | 0.06 | 0.028 | 0.05 | 14.8 | 120 |
| Example 24 | 0.05 | 0.18 | 0.02 | 14.3 | 124 |
| Comp. Ex. 1 | 0.11 | 0.029 | 0.07 | 14.3 | 120 |
| Comp. Ex. 2 | 0.15 | 0.028 | 0.08 | 14.1 | 120 |
| Comp. Ex. 3 | 0.13 | 0.029 | 0.09 | 14.5 | 120 |
| Comp. Ex. 4 | 0.12 | 0.031 | 0.125 | 15.5 | 120 |
| Comp. Ex. 5 | 0.12 | 0.032 | 0.05 | 15.5 | 120 |
| Comp. Ex. 6 | 0.13 | 0.033 | 0.06 | 15.4 | 120 |
| Comp. Ex. 7 | 0.11 | 0.027 | 0.04 | 15.2 | 120 |
| Comp. Ex. 8 | 0.12 | 0.033 | 0.05 | 15.6 | 140 |
| Comp. Ex. 9 | 0.11 | 0.031 | 0.04 | 15.2 | 140 |
| Comp. Ex. 10 | 0.115 | 0.033 | 0.08 | 14.6 | 120 |
| Comp. Ex. 11 | 0.11 | 0.018 | 0.01 | 49.0 | 120 |
| Comp. Ex. 12 | 0.11 | 0.018 | 0.02 | 43.0 | 120 |
| Comp. Ex. 13 | 0.11 | 0.02 | 0.02 | 89.0 | 120 |

As is understood from the results in Table 1, in Examples 1 to 24, images having a sufficient density with reduced fogging can be obtained while maintaining low-temperature fixability. In Comparative Examples 1 to 13, on the other hand, fogging is observed because of considerable voids. In Comparative Example 4, fogging occurs, and the density of the image is insufficient. In Comparative Examples 5 to 10, in particular, the image density is insufficient because of insufficient dispersibility of the pigment. In Comparative Examples 8 and 9, since many coarse powders are present in the crystalline resin fine particles, low-temperature fixability is also insufficient. In Comparative Examples 11 to 13, since the dispersibility of the pigment is low and L* is decreased, the image is dark and a vivid image cannot be obtained.

What is claimed is:

1. A toner for development of an electrostatic image, comprising at least a crystalline polyester resin and a colorant, the toner showing a dielectric loss index ∈" of 0.05 or less at 0.1 Hz and 500 V at 30° C. and 90% RH, the toner showing the dielectric loss index ∈" is obtained by:

mixing a resin particle dispersion liquid in which binder resin particles including the crystalline polyester resin are dispersed and a colorant dispersion liquid in which the colorant is dispersed, to form a mixture;

adding an aggregation agent to the mixture to form aggregated particles;

heating the aggregated particles to a temperature in the range of the melting point of the crystalline polyester resin ±about 5° C.; and adding an acid and a surfactant to fuse and coalesce the aggregated particles.

2. The toner for development of an electrostatic image according to claim 1, wherein the dielectric loss index ∈" at 1000 Hz and 3 V at 30° C. and 90% RH is in the range of from about 0.01 to about 0.03.

3. The toner for development of an electrostatic image according to claim 1, wherein the crystalline polyester resin comprises an acid-derived constituent component derived from an aliphatic dicarboxylic acid.

4. The toner for development of an electrostatic image according to claim 1, wherein the crystalline polyester resin comprises an acid-derived constituent component derived from a dicarboxylic acid having a double bond.

5. The toner for development of an electrostatic image according to claim 3, wherein a ratio of a total amount of an acid-derived constituent component other than the aliphatic dicarboxylic acid-derived constituent component to an amount of the aliphatic dicarboxylic acid-derived constituent component is from about 1 to about 20 constituent mol %.

6. The toner for development of an electrostatic image according to claim 1, wherein a ratio of a total amount of a constituent component derived from a diol having a double bond and a constituent component derived from a diol having a sulfonic acid group to a total amount of an alcohol-derived constituent component in the crystalline polyester resin is from 1 to 20 constituent mol %.

7. The toner for development of an electrostatic image according to claim 1, wherein the melting point of the crystalline polyester resin is from about 50 to about 120° C.

8. The toner for development of an electrostatic image according to claim 1, further comprising a non-crystalline polyester resin.

9. The toner for development of an electrostatic image according to claim 8, wherein the non-crystalline polyester resin comprises two or more different molecular weight components, the molecular weight components include a first component having a weight average molecular weight Mw from about 30,000 to about 200,000 and a second component having a weight average molecular weight Mw from about 8,000 to about 25,000.

10. The toner for development of an electrostatic image according to claim 9, wherein a molar ratio of an amount of the first component to an amount of the second component is in the range of from about 10/90 to about 70/30.

11. The toner for development of an electrostatic image according to claim 1, wherein the colorant is a carbon black having a primary particle diameter in the range of from about 20 nm to about 50 nm.

12. The toner for development of an electrostatic image according to claim 1, further comprising a release agent, wherein the release agent is a hydrocarbon wax.

13. The toner for development of an electrostatic image according to claim 12, wherein the peak of an endothermic profile of the release agent as determined by differential thermal analysis is in the range of from about 85 to about 95° C., a proportion of the endothermic area at 85° C. or less to the entire endothermic area in the endothermic profile of the release agent determined by differential thermal analysis is from about 5 to about 15%, and a content of the release agent in the toner as determined from the height of the peak of the endothermic profile is from about 6 to about 15% by weight.

14. The toner for development of an electrostatic image according to claim 12, wherein a viscosity of the release agent at 140° C. as determined with an E type viscometer equipped with a cone plate with a cone angle of 1.34 degrees is in the range of from about 1.50 to about 5.0 mPa·s.

15. The toner for development of an electrostatic image according to claim 1, further comprising an external additive including a hydrophobic silica having a primary particle diameter in the range of from about 5 to about 20 nm that has been externally added to the toner.

16. A method for manufacturing the toner for development of an electrostatic image of claim 1, the method comprising:

mixing a resin particle dispersion liquid in which binder resin particles including the crystalline polyester resin are dispersed and a colorant dispersion liquid in which a colorant is dispersed, so as to form a mixture;

adding an aggregating agent to the mixture to form aggregated particles; and heating the aggregated particles and adding an acid and a surfactant to fuse and coalesce the aggregated particles.

17. The method for manufacturing the toner for development of an electrostatic image according to claim 16, wherein preparation of the resin particle dispersion liquid comprises heating to a temperature in the range of (the melting point of the crystalline polyester resin ±about 5° C.) and cooling to about 40° C. or less at a rate from about 6° C./min. to about 20° C./min.

18. A developer for an electrostatic image comprising the toner for development of an electrostatic image of claim 1.

19. The developer for an electrostatic image according to claim 18, further comprising a carrier wherein the carrier is magnetic particles coated with a resin, and the resin has a basic carbon black dispersed therein.

20. A toner cartridge comprising at least the toner for development of an electrostatic image of claim 1.

21. A process cartridge comprising at least a developer holder, wherein the developer holder accommodates the developer for an electrostatic image of claim 19.

22. An image forming apparatus comprising an image holding member, a charging unit that charges the image holding member, an exposure unit that forms an electrostatic latent image on the image holding member that has been charged by the charging unit, a developing unit that develops the electrostatic latent image formed on the surface of the image holding member with a developer to form a toner image, a transfer unit that transfers the toner image formed on the image holding member onto an image receiving member, and a fixing unit that fixes the toner image that has been transferred onto the image receiving member, the developer being the developer for an electrostatic image of claim 19.

23. The image forming apparatus according to claim 22, wherein the charging unit is a charging roll.

24. The toner for development of an electrostatic image according to claim 1, wherein a ration of a total amount of a constituent component derived from a diol having a double bond and a constituent component derived from a dial having a sulfonic acid group to a total amount of an alcohol-derived constituent component in the crystalline polyester resin is from 2 to 20 constituent mol %.

* * * * *